US007918529B2

(12) United States Patent
Mitsuzawa

(10) Patent No.: US 7,918,529 B2
(45) Date of Patent: Apr. 5, 2011

(54) LIQUID EJECTING APPARATUS AND METHOD FOR ADJUSTING POSITIONS OF NOZZLE ROWS

(75) Inventor: Toyohiko Mitsuzawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 12/505,798

(22) Filed: Jul. 20, 2009

(65) Prior Publication Data

US 2009/0309910 A1 Dec. 17, 2009

Related U.S. Application Data

(63) Continuation of application No. 10/771,515, filed on Feb. 5, 2004, now Pat. No. 7,591,526.

(30) Foreign Application Priority Data

Feb. 6, 2003 (JP) ..... 2003-029720

(51) Int. Cl.
*B41J 29/393* (2006.01)
*B41J 2/015* (2006.01)
*B41J 23/00* (2006.01)

(52) U.S. Cl. ..... 347/20; 347/37; 347/19

(58) Field of Classification Search ..... 347/20, 347/37, 40, 19

See application file for complete search history.

(56) References Cited

U.S. PATENT DOCUMENTS

| | | | | |
|---|---|---|---|---|
| 6,092,887 | A | 7/2000 | Tanino et al. | |
| 6,416,165 | B1 | 7/2002 | Meyer et al. | |
| 6,575,557 | B2 | 6/2003 | Tominaga | |
| 6,902,254 | B2 | 6/2005 | Sugaya et al. | |
| 7,591,526 | B2 * | 9/2009 | Mitsuzawa | 347/20 |
| 2002/0033851 | A1 | 3/2002 | Waldner et al. | |
| 2002/0105558 | A1 | 8/2002 | Otsuki | |
| 2002/0126173 | A1 | 9/2002 | Sarmast et al. | |
| 2002/0140748 | A1 | 10/2002 | Kanaya et al. | |
| 2003/0048326 | A1 | 3/2003 | Yamasaki et al. | |

FOREIGN PATENT DOCUMENTS

| | | |
|---|---|---|
| JP | 03-234534 | 10/1991 |
| JP | 05-238004 | 9/1993 |
| JP | 05-301353 | 11/1993 |
| JP | 9-262992 A | 10/1997 |
| JP | 10-34980 | 10/1998 |
| JP | 2001-341293 | 12/2001 |

* cited by examiner

*Primary Examiner* — Julian D Huffman
*Assistant Examiner* — Jason S Uhlenhake
(74) *Attorney, Agent, or Firm* — Michael T. Gabrik

(57) ABSTRACT

A liquid ejecting apparatus comprises a moving unit that moves by receiving a moving force, and a plurality of nozzle rows for ejecting liquid onto a medium, wherein each of the nozzle rows is adjusted in its position on the moving unit, taking a nozzle row that is arranged on a side close to a line of action of the moving force as a reference.

13 Claims, 15 Drawing Sheets

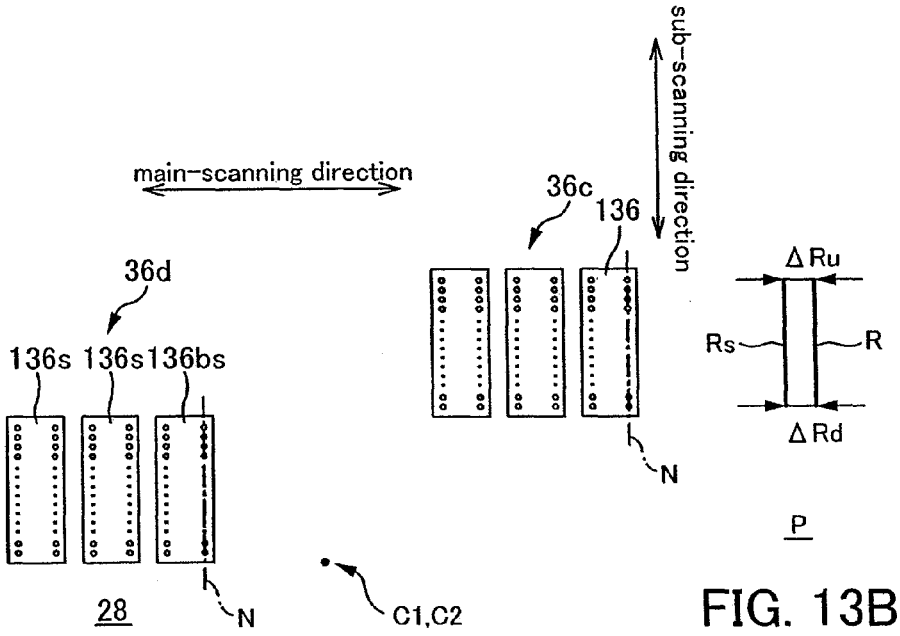
FIG. 13B
FIG. 13A
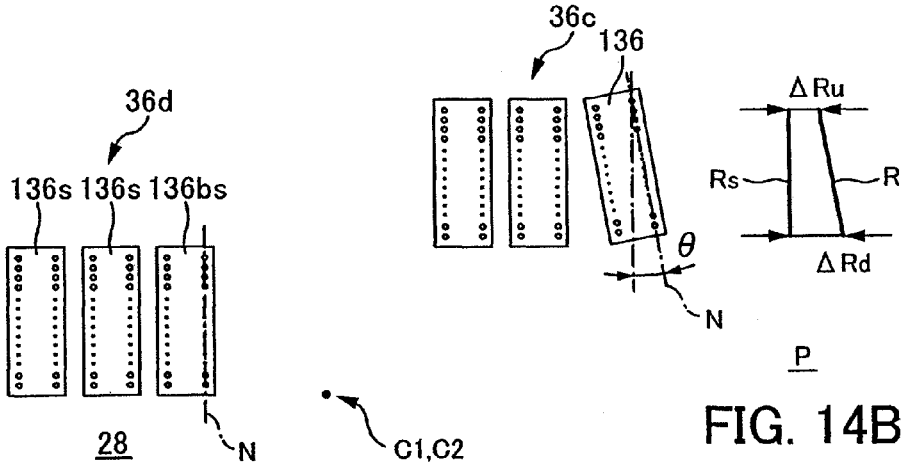
FIG. 14B
FIG. 14A

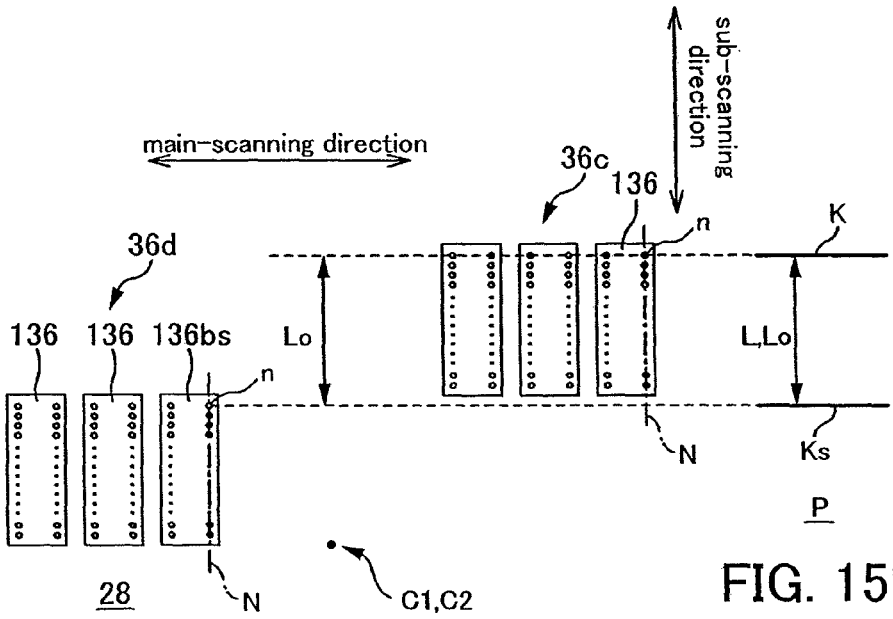
FIG. 15A
FIG. 15B
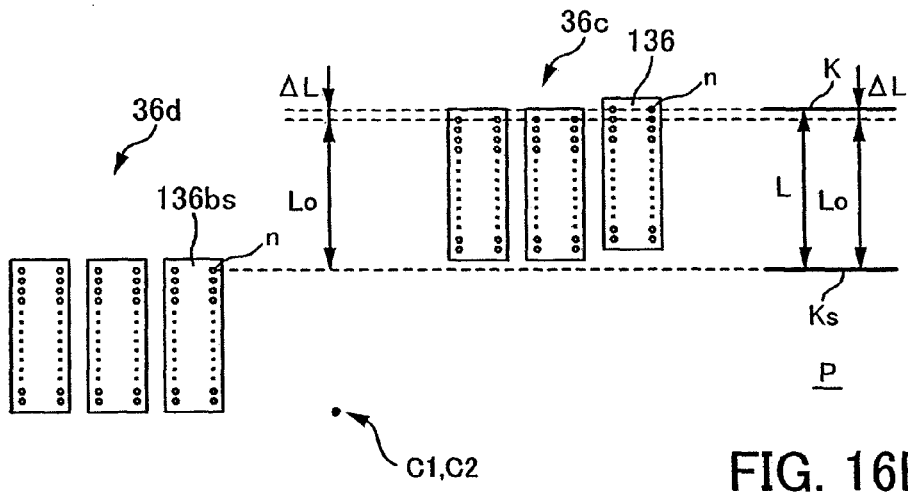
FIG. 16B
FIG. 16A

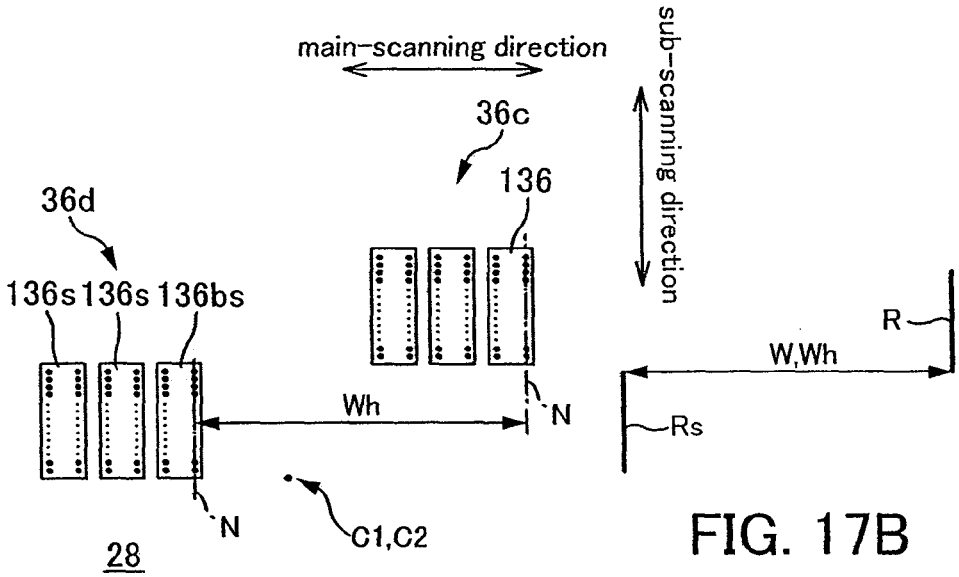
FIG. 17A
FIG. 17B
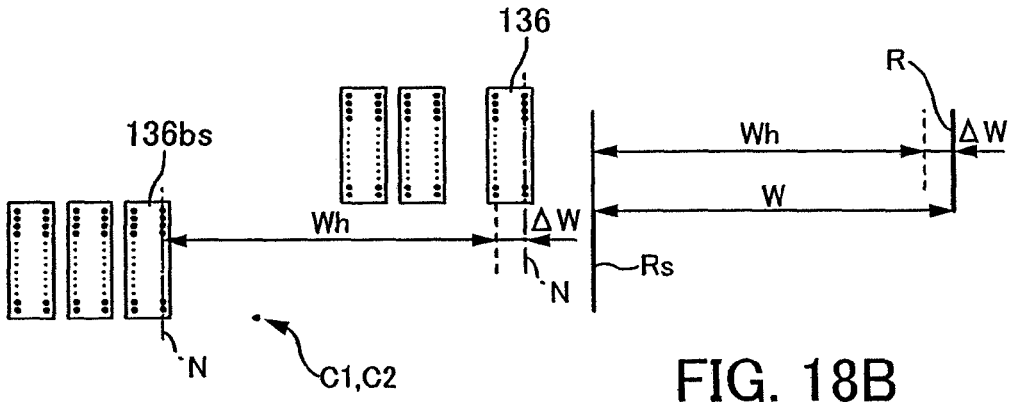
FIG. 18A
FIG. 18B

LIQUID EJECTING APPARATUS AND METHOD FOR ADJUSTING POSITIONS OF NOZZLE ROWS

CROSS-REFERENCE TO RELATED APPLICATIONS

This is a continuation of application Ser. No. 10/771,515 filed Feb. 5, 2004. The entire disclosure of the prior application, application Ser. No. 10/771,515 is considered part of the disclosure of the accompanying continuation application and is hereby incorporated by reference. The present Application also claims priority from Japanese Patent Application No. 2003-29720 filed on Feb. 6, 2003, the disclosure of which is incorporated by reference.

BACKGROUND OF THE INVENTION

1. Field of the Invention

The present invention relates to liquid ejecting apparatuses provided with a moving unit that moves when it receives a moving force, and a plurality of nozzle rows for ejecting liquid onto a medium, and with which it is possible to adjust the positions of the nozzle rows on the moving unit, and methods for adjusting the positions of those nozzle rows.

2. Description of the Related Art

In recent years, inkjet printers that eject ink as a liquid have become particularly popular as liquid ejecting apparatuses for ejecting liquid from nozzle rows (made of numerous nozzles arranged in lines) onto a medium. These inkjet printers are provided with a print head provided with a plurality of nozzle rows, and a carriage that is for holding the print head and that is capable of moving back and forth in a main-scanning direction. Print paper, serving as a medium, is fed intermittently in a sub-scanning direction, which is perpendicular to the main-scanning direction, and during the pauses in this feeding, the carriage is moved in the main-scanning direction and ink droplets are ejected from the nozzle rows toward the print paper so as to form numerous dot rows (numerous rows of dots, which are formed by ink droplets that have landed, arranged in straight lines). The paper feeding and movement of the carriage are repeated in alternation, forming a predetermined print image on the print paper. There has been increased diversity in the type of such inkjet printers in recent years, and for example, large-size inkjet printers in which a plurality of print heads are provided adjacent each other in the carriage so as to allow large size paper, such as A0 size paper, to be printed have also become available.

The print image formed by such inkjet printers is made of numerous dot rows formed by ejecting droplets of ink from the nozzle rows. Therefore, if the positions where dot rows are formed, which are the positions where the ink droplets land on the print paper, deviate from expected design positions, then an attractive print image cannot be printed on the print paper. In particular, in the case of a large-size inkjet printer provided with a plurality of print heads as described above, if the positions of the nozzle rows are not consistent among the plurality of print heads on the carriage, then there will be a lack of coordination in the positions where the dot rows are formed among the print heads, and if all of the print heads are used to draw a single print image, then an attractive print image cannot be obtained.

Consequently, with regard to such large-size printers, a printer that allows the positions of the print heads on the carriage to be adjusted individually has been proposed (for example, Japanese Patent Application Laid-open Publication No. 9-262992). With such a configuration, by appropriately moving each print head in the main-scanning direction or the sub-scanning direction, the positions of the nozzle rows on the carriage are coordinated, i.e., adjusted for suitable arrangement.

The publication above, however, does not disclose which print head, among the plurality of print heads on the carriage, should be taken as a reference when adjusting the positions. Thus, if the print head that is taken as the reference is prone to vibration during carriage movement, the positions where dot rows are formed by the reference print head will fluctuate, and it is difficult to coordinate the dot-row formation positions among the print heads even if the positions of the other print heads are precisely adjusted with respect to the reference. As a result, an attractive print image cannot be obtained.

SUMMARY OF THE INVENTION

The present invention has been made in view of the foregoing issues, and it is an object thereof to achieve a liquid ejecting apparatus in which it is possible to accurately coordinate the nozzle rows with one another, as regards the positions where liquid that has been ejected onto a medium lands, and also a method for adjusting the positions of those nozzle rows.

A main aspect of the present invention is a liquid ejecting apparatus comprising: a moving unit that moves by receiving a moving force; and a plurality of nozzle rows for ejecting liquid onto a medium, wherein each of the nozzle rows is adjusted in its position on the moving unit, taking a nozzle row that is arranged on a side close to a line of action of the moving force as a reference.

Other features of the present invention will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 5 is an explanatory diagram of nozzle row units, where

FIGS. 13A and 13B are explanatory diagrams for describing a method for adjusting the positions of the nozzle row units;

FIGS. 14A and 14B are explanatory diagrams for describing a method for adjusting the positions of the nozzle row units;

FIG. 15 is an explanatory diagram for describing a method for adjusting the positions of the nozzle row units;

FIG. 16 is an explanatory diagram for describing a method for adjusting the positions of the nozzle row units;

FIG. 17 is an explanatory diagram for describing a method for adjusting the positions of the nozzle row units;

FIG. 18 is an explanatory diagram for describing a method for adjusting the positions of the nozzle row units.

DETAILED DESCRIPTION OF THE INVENTION

Figure 1:
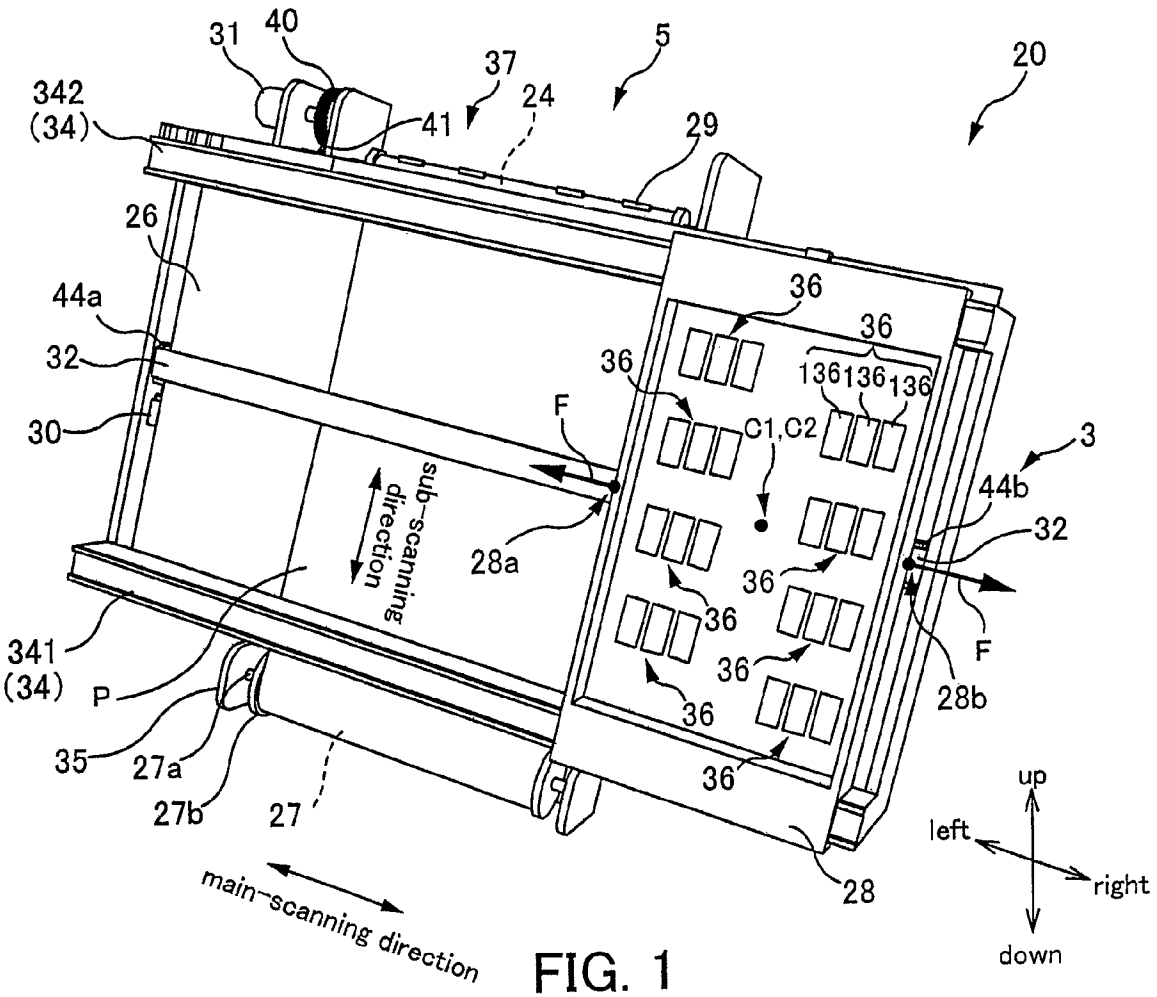
FIG. 1 is a perspective view showing an overview of a first embodiment of a color printer according to the present invention.

At least the following matters will be made clear by the detailed explanation of the invention in the present specification.

An aspect of the present invention is liquid ejecting apparatus comprising: a moving unit that moves by receiving a moving force; and a plurality of nozzle rows for ejecting liquid onto a medium, wherein each of the nozzle rows is adjusted in its position on the moving unit, taking a nozzle row that is arranged on a side close to a line of action of the moving force as a reference.

With such a liquid ejecting apparatus, the positions of the nozzle rows are adjusted taking a nozzle row on the side close to the line of action of the moving force as a reference. This is because the closer a section is to the line of action on the moving unit, the smaller its vibration during movement due to the direct transmission of the moving force. That is, the closer the nozzle row is to the line of action, the smaller the discrepancy due to vibration is in the positions where liquid ejected toward the medium during movement lands. Also, since the positions of the other nozzle rows are adjusted taking this nozzle row with small landing-position discrepancy as a reference, it is possible to accurately coordinate the landing positions among the nozzle rows.

It should be noted that "line of action" mentioned above is generally defined as "a line that passes through points upon which a force acts and that is in the direction of the force." Therefore, the line of action of the moving force indicates "a line that passes through points upon which the moving force acts and that is in the direction of the moving force."

In this liquid ejecting apparatus, it is preferable that the position of each of the nozzle rows is adjusted taking a nozzle row that is arranged closest to the line of action of the moving force as a reference.

With such a liquid ejecting apparatus, the nozzle row that is arranged closest to the line of action is taken as a reference, that is, a single common nozzle row serves as a reference for adjusting the positions of the other nozzle rows, and thus the positions where liquid lands can be more accurately coordinated among the nozzle rows.

In this liquid ejecting apparatus, it is preferable that: the moving unit receives the moving force in opposite directions at a pair of points of action located on the line of action, and moves back and forth due to the moving force; and the position of each of the nozzle rows is adjusted taking a nozzle row, among a plurality of nozzle rows that are arranged closest to the line of action, that is arranged closest to a center point between the pair of points of action as a reference.

With such a liquid ejecting apparatus, the section where the vibration of the moving unit, as it moves back and forth by receiving the moving force, becomes on average the smallest is the center point between a pair of points of action of the moving force. Position adjustment is carried out taking the nozzle row closest to this center point as a reference. That is, the nozzle row having the smallest vibration in the moving unit is taken as a reference for adjusting the positions of the nozzle rows, and thus the positions where liquid lands can be most accurately coordinated among the nozzle rows.

In this liquid ejecting apparatus, it is preferable that: the medium is intermittently carried in a direction that intersects with a direction of movement of the moving unit; and while the medium is stopped, the moving unit moves and ejects liquid onto the medium.

With such a liquid ejecting apparatus, the medium is intermittently carried in a direction that intersects with the direction in which the moving unit moves, and liquid is ejected when the paper is stopped. Liquid can thus be ejected onto the medium in the direction of intermittent carrying, and therefore, a wide surface of the medium made up of the direction of movement and the direction of intermittent carrying can serve as a target for ink ejection.

In this liquid ejecting apparatus, it is preferable that: dots are formed by ejecting liquid from each of the nozzle rows onto the medium; and the position is adjusted based on dot rows formed on the medium.

With such a liquid ejecting apparatus, adjustment is performed based on the positions where dot rows are formed, which are the positions where the liquid lands, and thus it is possible to more directly align the positions where the liquid lands. Consequently, the positions where liquid lands can be more accurately aligned among the nozzle rows.

In the liquid ejecting apparatus, it is preferable that a liquid droplet amount per nozzle for forming the dot rows for adjusting the position is less than a maximum liquid droplet amount ejected by the nozzle.

With such a liquid ejecting apparatus, the amount of liquid droplets per nozzle for forming the dot rows for position adjustment is less than a maximum liquid droplet amount that is ejected by the nozzle. The reason for this is because the amount of liquid droplets may cause a change in the ejection velocity, for example, which may cause a slight change in the position where the liquid droplets land, and in this case, it would be possible to make position adjustments in a state that is closer to the state during actual use by performing alignment with the amount of liquid droplets that is adopted for actual use, which is usually an amount that is less than the maximum liquid droplet amount.

Consequently, with this liquid ejecting apparatus, position adjustment is performed based on dot rows made of droplets whose amount is less than a maximum liquid droplet amount, i.e., dot rows that are close to actually used dot rows, and thus coordination of the positions where liquid lands can be more accurately carried out among the nozzle rows.

In the liquid ejecting apparatus, it is also possible that each of the nozzle rows is a single row in which a plurality of nozzles have been arranged in a line.

In the liquid ejecting apparatus, it is preferable that: the moving unit includes a plurality of nozzle row groups, each of the nozzle row groups being made of a plurality of the nozzle rows; and the position of the nozzle rows is adjustable in units of the nozzle row groups.

With such a liquid ejecting apparatus, the nozzle row groups are provided with a plurality of nozzle rows, and thus, by adjusting the positions of a nozzle row group, it is possible to adjust the position of a plurality of nozzle rows at once. In this way, the effort required for adjusting the positions of the nozzle rows can be reduced.

In the liquid ejecting apparatus, it is preferable that each of the nozzle row groups is a print head, the print head including at least a nozzle row capable of ejecting black ink, a nozzle row capable of ejecting cyan ink, a nozzle row capable of ejecting magenta ink, and a nozzle row capable of ejecting yellow ink.

With such a liquid ejecting apparatus, it is possible to print in full color.

In the liquid ejecting apparatus, it is preferable that the adjustment of the position of each of the nozzle rows includes aligning of an orientation of each of the nozzle rows with respect to the nozzle row that has been taken as the reference.

With such a liquid ejecting apparatus, the orientation of each of the nozzle rows is aligned, and therefore, it is possible to coordinate, among the nozzle rows, the positions where liquid lands.

In the liquid ejecting apparatus, it is preferable that the adjustment of the position of each of the nozzle rows includes aligning of a relative position, in a direction of movement of the moving unit, of each of the nozzle rows with respect to the nozzle row that has been taken as the reference.

With such a liquid ejecting apparatus, the relative positions of the nozzle rows in the direction of movement of the moving unit are aligned, and therefore, it is possible to coordinate, among the nozzle rows, the positions where liquid lands.

In the liquid ejecting apparatus, it is preferable that: the medium is intermittently carried in a direction that intersects with a direction of movement of the moving unit; and the adjustment of the position of each of the nozzle rows includes aligning of a relative position, in the direction of the intermittent carrying, of each of the nozzle rows with respect to the nozzle row that has been taken as the reference.

With such a liquid ejecting apparatus, the relative positions of the nozzle rows in the direction of intermittent carrying are aligned, and therefore, it is possible to coordinate, among the nozzle rows, the positions where liquid lands.

In the liquid ejecting apparatus, it is preferable that the liquid is an ink for printing a print image on the medium.

With such a liquid ejecting apparatus, a print image in which the positions where liquid lands have been coordinated among the nozzle rows can be printed on the medium, and thus an attractive print image can be printed.

In the liquid ejecting apparatus, it is preferable that a single image is created using at least two of the nozzle rows whose positions are adjustable independent of one another.

With such a liquid ejecting apparatus, at least two nozzle rows are used to create a single image, and thus images can be formed in a shorter time.

Another aspect of the present invention is a liquid ejecting apparatus comprising: a moving unit that moves back and forth by receiving a moving force in opposite directions at a pair of points of action located on a line of action of the moving force; and a plurality of print heads made of a plurality of nozzle rows for ejecting ink, onto a medium that is intermittently carried in a direction that intersects with a direction of movement of the moving unit, from the moving unit that moves when the medium is stopped, wherein each of the nozzle rows is a single row in which a plurality of nozzles have been arranged in a line; wherein each of the print heads includes at least a nozzle row capable of ejecting black ink, a nozzle row capable of ejecting cyan ink, a nozzle row capable of ejecting magenta ink, and a nozzle row capable of ejecting yellow ink; wherein a position on the moving unit is adjustable in units of the print heads; wherein a single print image is printed using at least two of the print heads whose positions are adjustable independent of one another; wherein the position of each of the print heads is adjusted taking a nozzle row of a print head, among print heads that are arranged closest to the line of action, that is arranged closest to a center point between the pair of points of action as a reference; wherein dots are formed by ejecting ink from a nozzle row of each of the print heads onto the medium, and the position of each of the print heads is adjusted based on dot rows formed on the medium; wherein an ink droplet amount per nozzle for forming the dot rows is less than a maximum ink droplet amount ejected by the nozzle; and wherein the adjustment of the position of each of the print heads includes aligning of an orientation of the nozzle rows of each of the print heads with respect to the nozzle row of the print head that has been taken as the reference, aligning of a relative position, in the direction of movement of the moving unit, of the nozzle rows of each of the print heads with respect to the nozzle row of the print head that has been taken as the reference, and aligning of a relative position, in the direction of the intermittent carrying, of the nozzle rows of each of the print heads with respect to the nozzle row of the print head that has been taken as the reference.

With such a liquid ejecting apparatus, it is possible to attain all of the effects mentioned above, and thus the object of the present invention is most effectively achieved.

It is also possible to achieve a method for adjusting positions of nozzle rows of a liquid ejecting apparatus that is provided with a moving unit that moves by receiving a moving force, and a plurality of nozzle rows for ejecting liquid onto a medium, wherein a position, on the moving unit, of each of the nozzle rows is adjustable, the method comprising the step of: adjusting the position of each of the nozzle rows by taking a nozzle row that is arranged on a side close to a line of action of the moving force as a reference.

===Example of a Schematic Configuration of the Liquid Ejecting Apparatus===

FIG. 1 is a perspective view showing an overview of a color inkjet printer (hereinafter, referred to as "color printer") 20 serving as a first embodiment of the liquid ejecting apparatus.

The color printer 20 is an inkjet printer that is capable of outputting a color image, and, for example, is an inkjet-type printer for ejecting liquid, such as the six ink colors cyan (C), light cyan (LC), magenta (M), light magenta (LM), yellow (Y), and black (K), onto various types of media, such as print paper, to form dots and thereby print a print image. It should be noted that there is no limitation to the foregoing six colors, and it is also possible to use dark yellow (DY), for example, as well. Also, the color printer 20 is compatible with roll paper in which print paper has been wrapped around into a roll as shown in FIG. 1, and also with relatively large single sheet print paper such as A0 size paper in the JIS standard.

The color printer 20 has a print section 3 for ejecting ink to print on a roll paper P, and a print paper carry section 5 for carrying the roll paper P.

---(1) Print Section---

The print section 3 is provided with a carriage 28 serving as a moving unit for holding a plurality of print heads 36, a pair of upper and lower guide rails 34 for guiding the carriage 28 such that it can move back and forth in a direction (also referred to as the "main-scanning direction" or the "left and right direction") that is substantially perpendicular to the direction in which the roll paper P is carried (hereinafter, also referred to as the "sub-scanning direction"), a carriage motor 30 for moving the carriage 28 back and forth, and a pull belt 32 for transmitting the moving force of the carriage motor 30 to the carriage 28.

(A) Carriage

The carriage 28 is a substantially rectangular flat plate, and is supported on the guide rails 34 in a tilted manner with its lower end edge protruding more forward than its upper end edge. Engaging sections 28*a* and 28*b* for fastening the pull belt 32 are provided in the center, in the sub-scanning direction, of the left end edge and the right end edge, respectively, of the carriage 28. A moving force F in the left direction is imparted by the pull belt 32 from the left engaging section 28*a* to move the carriage 28 to the left in the main-scanning direction, and conversely, a moving force F in the right direction is imparted from the right engaging section 28*b* to move the carriage 28 to the right in the main-scanning direction.

It should be noted that the moving force F is in the main-scanning direction, and therefore, the line of action of the moving force F (the line that is in the direction of the moving force and that passes through the points where the moving force acts) matches the line segment that joins the left and right engaging sections 28*a* and 28*b*. The moving force F is directly transmitted to the section close to this line of action, and thus at this section, the vibration when the carriage 28 is moving is small. This relates to the position adjustment of nozzle row units 136 of the print heads 36, which will be described later.

Eight print heads 36 are disposed over the entire surface of the carriage 28. The print head 36 is shown enlarged in FIG. 2, and each print head 36 has numerous nozzles n for ejecting ink. Also, these nozzles n are lined up side by side in rows at a predetermined nozzle pitch k·D in the sub-scanning direction, forming nozzle rows N. Six nozzle rows N are provided per print head 36, and the nozzle rows N are provided side by side in the main-scanning direction at a design pitch of Wn. It should be noted that the arrangement of the print heads 36 and the nozzles n is discussed later.

Figure 2:
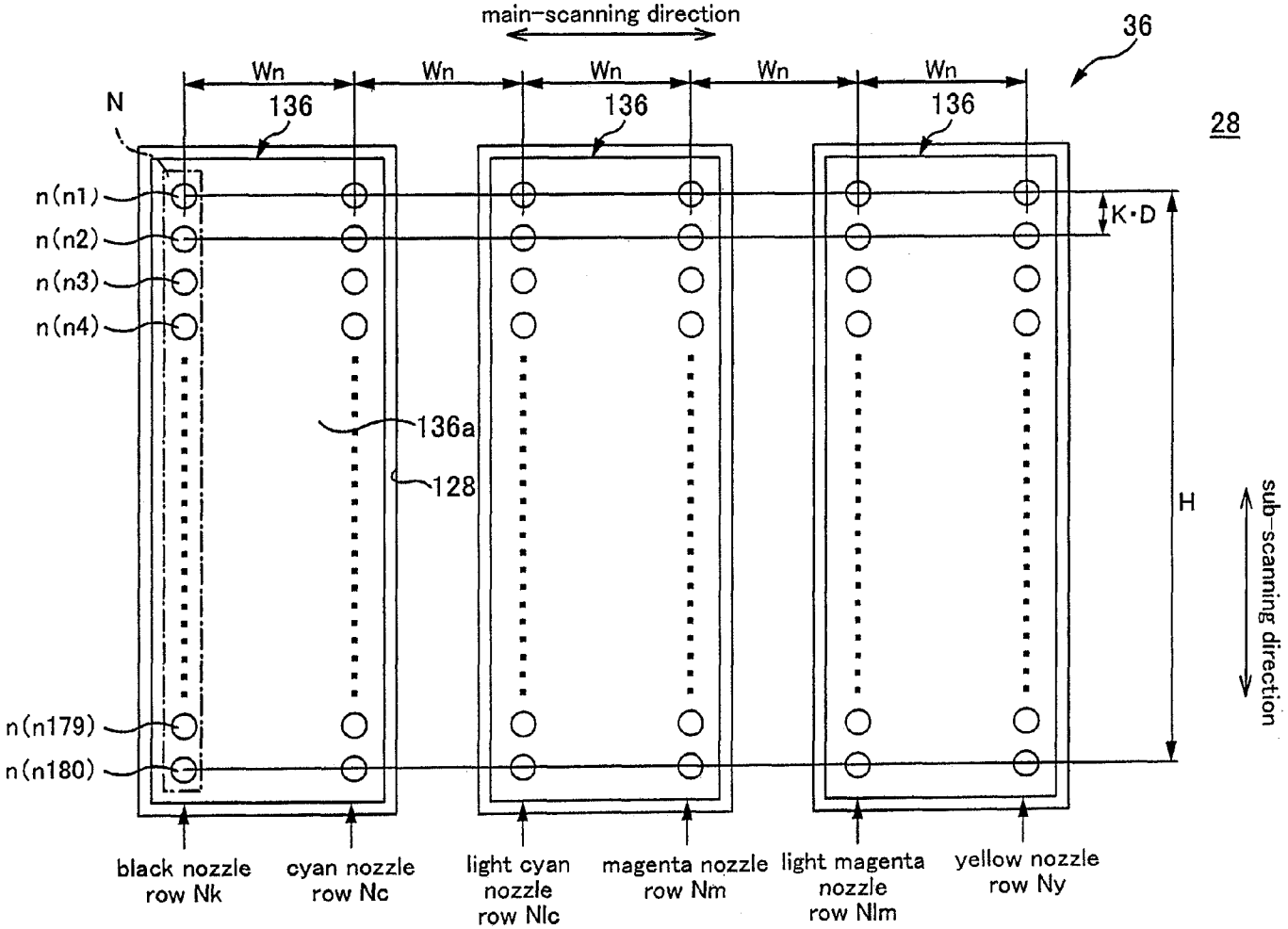
FIG. 2 is a diagram showing a larger view of a print head.
Figure 3:
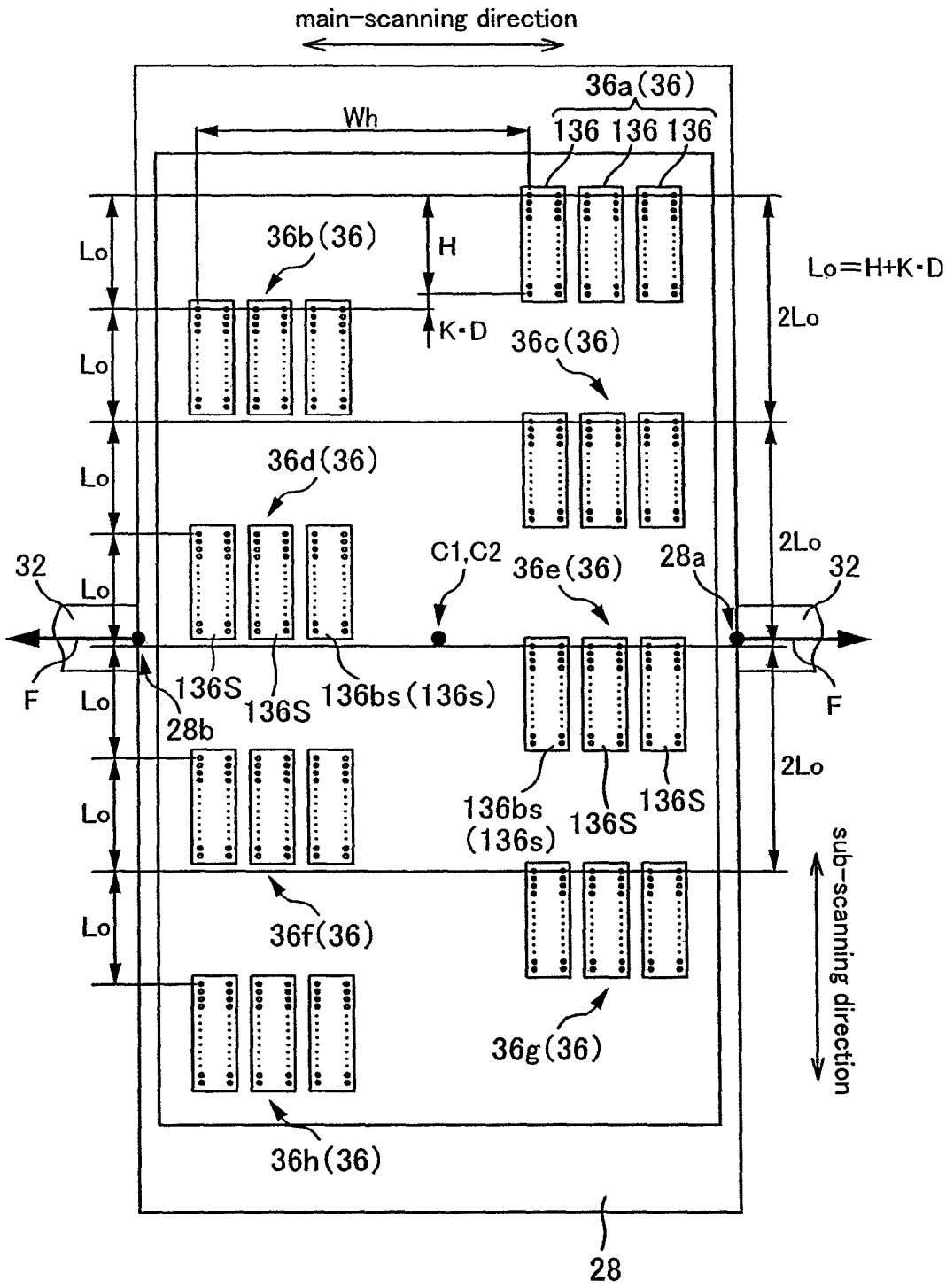
FIG. 3 is a surface arrangement diagram of print heads on a carriage.

FIG. 3 shows a plan arrangement diagram of the print heads 36 on the carriage 28. This diagram shows the carriage 28 from its rear surface side, that is, from the side of a platen 26, which will be discussed later, and therefore, the left and right are inverted as compared to FIG. 1. As shown in the diagram, with the center in the left and right direction of the carriage 28 surface serving as a boundary, four print heads 36 are disposed in the left side region and four print heads 36 are disposed on the right side region. The print heads 36 of these regions are arranged in straight lines at a design pitch 2L0 (=2(H+k·D)) in the sub-scanning direction. That is, in each region, the print heads 36 arranged adjacent to one another in the sub-scanning direction are disposed with a spacing therebetween equivalent to the length of one print head 36. It should be noted that here, H indicates the total length of the nozzle rows N as shown in FIG. 2, and hereinafter may also be referred to as the "head length."

On the other hand, as shown in FIG. 3, the print heads 36 that are adjacent to one another to the left and right are arranged at a design pitch Wh in the main-scanning direction, and in the sub-scanning direction they are shifted by half of the design pitch 2L0 with respect to one another, and thus, the print heads 36 are arranged in a zigzag (staggered) manner to the left and right on the carriage 28 surface. More specifically, the print heads 36 in the region of one side (for example, the right side region) are disposed so that they correspond to the interval portion in which there are no print heads 36 in the region of the other side (for example, the left side region), and thus the interval portion in which there are no print heads 36 in each of those regions compensate for one another. Consequently, when the eight print heads 36 are aligned on the carriage 28, it is as if the carriage 28 has nozzle rows with a total length that is substantially eight times the length of the nozzle row N, and thus a large print image can be printed in a very short time (see FIG. 10).

It should be noted that the plan arrangement center C2 of the eight print heads 36 matches the surface center C1 of the carriage 28. Consequently, the line segment that joins the left and right engaging sections 28*a* and 28*b* of the pull belt 32 divides the plan arrangement of the print heads 36 into two vertically in the sub-scanning direction, and the center point of the line segment for the engaging sections 28*a* and 28*b* matches the plan arrangement center C2. That is, the line segment that joins the engaging sections 28*a* and 28*b* is positioned between the second print head 36 from the top in the left side region of the carriage 28 surface in FIG. 3 and the third print head 36 from the top in the right side region, and four print heads 36 are disposed in the region that is above this line segment and the remaining four print heads 36 are disposed in the region that is below this line segment.

(B) Guide Rails

As shown in FIG. 1, two guide rails 34 are provided in the main-scanning direction. These guide rails 34 are disposed at upper and lower positions in the sub-scanning direction with a space between them, and at their left and right end sections they are supported by a frame (not shown) that serves as a base. As regards the two guide rails 34, a lower guide rail 341 is disposed more forward than an upper guide rail 342, and thus, the carriage 28 spanned between them maintains a tilted state in which its lower end edge is protruding forward, as mentioned above, as it moves back and forth in the main-scanning direction.

(C) Pull Belt

The pull belt 32 is a belt-shaped body made of metal, with one end fastened to the left engaging section 28*a* of the carriage 28 and its other end fastened to the right engaging section 28*b* after passing behind the rear surface of the carriage 28. Also, the pull belt 32 is stretched between a pair of pulleys 44*a* and 44*b* provided at left and right movement stroke ends of the carriage 28. Of these, the pulley 44*b* is linked to the carriage motor 30, and due to the carriage motor 30, a moving force F in the main-scanning direction is imparted to the carriage 28 via the pull belt 32, thereby moving the carriage 28 in the main-scanning direction.

---(2) Print Paper Carry Section---

The print paper carry section 5 is provided on the rear surface side of the two guide rails 34. Also, the print paper carry section 5 has a roll paper holding section 35 for rotatably holding the roll paper P provided lower than the lower guide rail 341, a roll paper carry section 37 for carrying the roll paper P provided above the upper guide rail 342, and the platen 26 over which the roll paper P is carried between the roll paper holding section 35 and the roll paper carry section 37.

(A) Platen

The platen 26 has a flat surface with a size that amounts to the entire width of the roll paper P that is carried, and is provided tilted in such a manner than its surface is parallel to the surface of the carriage 28 that is scanned back and forth in a tilted state. Also, the platen 26 is in opposition to the print heads 36, which are incorporated onto the carriage 28, with an even spacing between the platen 26 and the print heads 36. The platen 26 is provided with a suction mechanism 16 for stably carrying the roll paper P, and this is described later.

(B) Roll Paper Holding Section

The roll paper holding section 35 is provided with a holder 27 for rotatably holding the roll paper P. The holder 27 has a shaft unit 27*a* that serves as a rotation shaft that rotates with the roll paper P in a held state, and to both end sections of the shaft unit 27*a* are provided guide disks 27*b* for preventing the roll paper P that is supplied from zigzagging or getting skewed.

(C) Roll Paper Carry Section

The roll paper carry section 37 is provided with a SMAP roller (paper feed roller) 24 for carrying the roll paper P, a sandwiching roller 29 that is provided in opposition to the SMAP roller 24 and that sandwiches the roll paper P between itself and the SMAP roller 24, and a carry motor 31 for rotating the SMAP roller 24. A drive gear 40 is provided at the shaft of the carry motor 31, and a relay gear 41 that meshes with the drive gear 40 is provided at the shaft of the SMAP roller 24. The drive force of the carry motor 31 is transmitted to the SMAP roller 24 via the drive gear 40 and the relay gear 41. That is, the roll paper P that is held by the holder 27 is sandwiched between the SMAP roller 24 and the sandwiching roller 29 and is carried along the platen 26 by the carry motor 31.

(D) Suction Mechanism of the Platen

Figure 4:
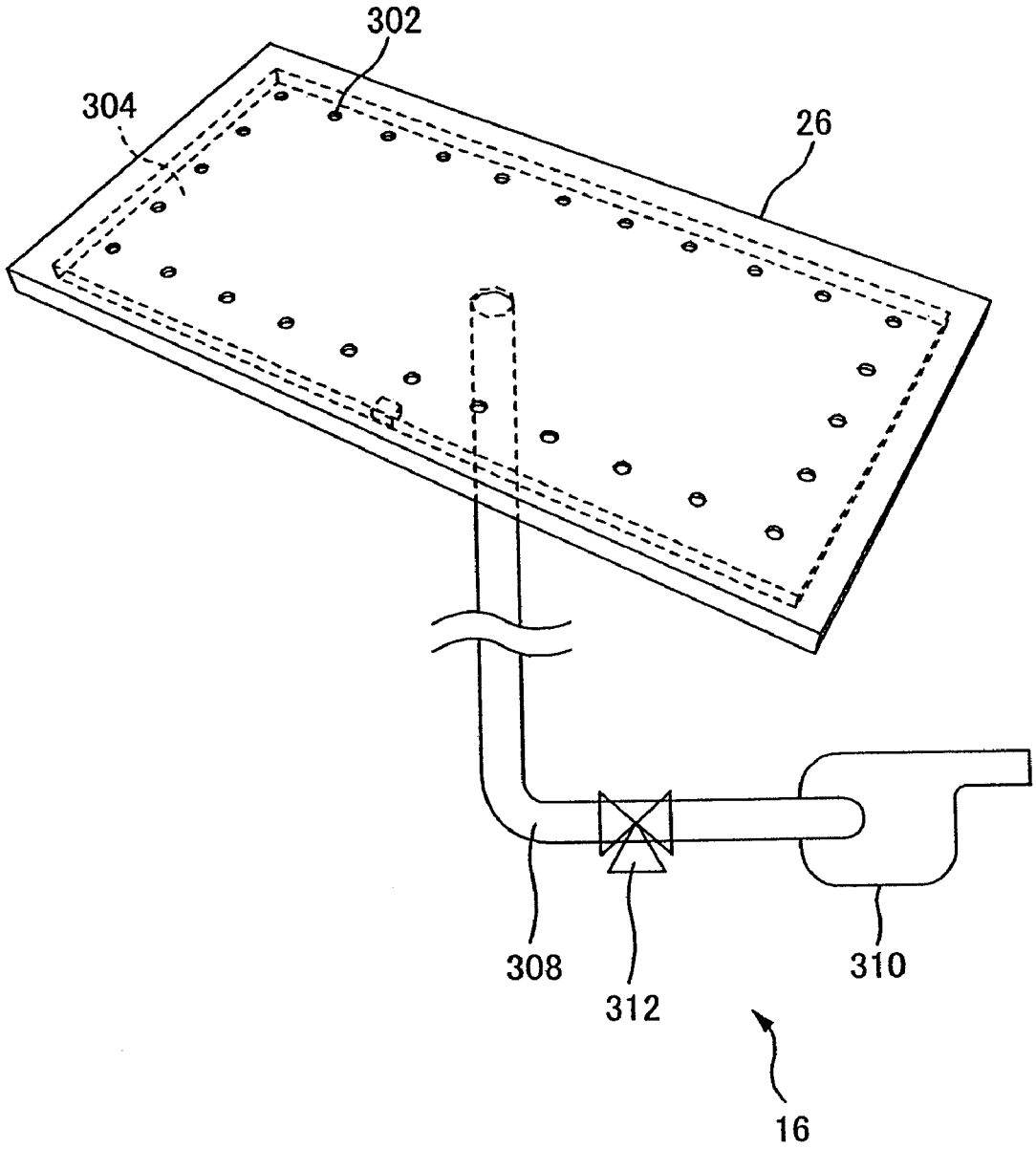
FIG. 4 is a conceptual diagram illustrating a suction mechanism of a platen.

FIG. 4 is a conceptual diagram illustrating the suction mechanism 16 in the platen 26. Numerous suction apertures 302 are provided in the platen 26 in a loop along the circumference section of the platen 26 in the surface over which the roll paper P is carried. The suction apertures 302 are in communication with a chamber 304 provided inside the platen 26. The chamber 304 is provided on the rear surface side of the platen 26 and is in communication with the suction mechanism 16, which is for sucking out air in within the chamber 304. That is, the suction mechanism 16 is in communication with the outside of the platen 26 via the numerous suction apertures 302 and the chamber 304.

The suction mechanism 16 has a suction blower 310 for sucking in the air within the chamber 304 to make the chamber 304 a vacuum, a hose 308 connecting the suction blower 310 and the chamber 304, and a switch valve 312 provided within the hose 308. The switch valve 312 is constituted by an electromagnetic three-way valve that has an air release opening. When the suction blower 310 is driven, the pressure within the chamber 304 drops, and the roll paper P carried along the platen 26 is sucked via the numerous suction apertures 302 and carried in a flat state along the platen 26 without bending. It should be noted that atmosphere can be released into the chamber 304 by switching the switch valve 312.

===Configuration of the Print Heads===

---(1) Nozzle Arrangement of the Print Heads---

As shown in FIG. 2, the print heads 36 each have six nozzle rows N made of numerous nozzles n arranged in straight lines in the sub-scanning direction. The nozzle rows N are arranged side by side at a design pitch Wn in the main-scanning direction. In this embodiment, a black nozzle row Nk, a cyan nozzle row Nc, a light cyan nozzle row Nlc, a magenta nozzle row Nm, a light magenta nozzle row Nlm, and a yellow nozzle row Ny serve as the nozzle rows N for each ink color that is ejected. Also, the print heads 36 are of such a nature that their position on the carriage 28 can be adjusted in units of nozzle row units 136, which are nozzle row groups made of two nozzle rows. This is described later.

Each nozzle row N has 180 nozzles, n1 to n180, and each nozzle n is provided with a piezoelectric element (not shown) that serves as a drive element for driving the nozzle n to make it eject ink droplets. The nozzles n1, n2, . . . n180 of the nozzle rows N are disposed at a constant nozzle pitch k·D in the sub-scanning direction. Here, D is the dot pitch in the sub-scanning direction and k is an integer of one or more. It should be noted that the dot pitch D in the sub-scanning direction is equivalent to the pitch of the main-scanning lines (raster lines).

When printing, the roll paper P is intermittently carried by the print paper carry section 5 by a predetermined carry amount, and between these intermittent carries (i.e., when the paper is stopped), the carriage 28 moves in the main-scanning direction, during which time ink droplets are ejected from the nozzles n. Depending on the print mode, however, not all of the nozzles n may necessarily be used, and there also may be instances where only some of the nozzles n are used.

---(2) Nozzle Row Units of the Print Heads---

As mentioned above, the six nozzle rows N provided in each print head 36 are divided into units of two rows each. That is, each print head 36 is provided with three nozzle row units 136, each serving as a nozzle row group and constituted by two nozzle rows N. In FIG. 2, the black nozzle row Nk and the cyan nozzle row Nc make up the first nozzle row unit 136, the light cyan nozzle row Nlc and the magenta nozzle row Nm make up a second nozzle row unit 136, and the light magenta nozzle row Nlm and the yellow nozzle row Ny make up a third nozzle row unit 136. This allows the positions on the carriage 28 surface to be adjusted in units of nozzle row unit 136. It should be noted that, in this example, position adjustment is used to mean adjusting of the positions in the main-scanning direction and in the sub-scanning direction and also to mean aligning of the orientation of the nozzle rows N in the sub-scanning direction.

Figure 5A:
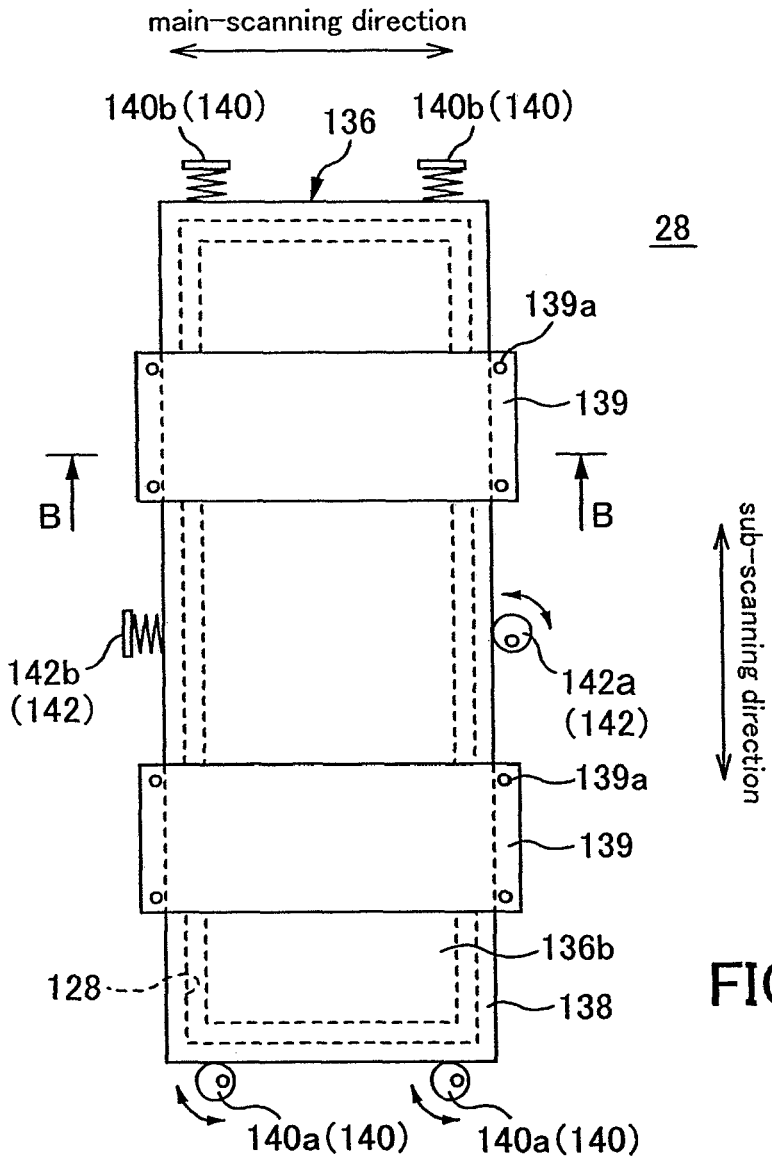
FIG. 5A is a diagram showing the nozzle row units seen from the rear side in FIG. 2.
Figure 5B:
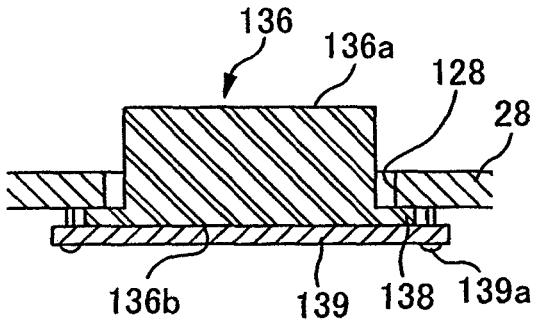
FIG. 5B is a cross-sectional view taken along the line B-B in FIG. 5A.

FIG. 5A shows a nozzle row unit 136 seen from the rear side of FIG. 2, and FIG. 5B shows a cross-sectional view taken along the line B-B indicated by arrows in FIG. 5A. As shown in FIG. 2 and FIG. 5, the nozzle row units 136 have a substantially rectangular external shape. Also, two nozzle rows N are arranged on a surface 136*a*, among the outer wall surfaces of the nozzle row unit 136, that is in opposition to the platen 26 when the unit 136 is incorporated onto the carriage 28 (hereinafter, also referred to as the "arrangement surface 136*a*"). These two nozzle rows N are arranged, in advance, parallel to one another at the design pitch Wn with very high precision, so that it is not necessary to later adjust the relative position between these two rows.

Also, as shown in FIG. 5, a brim-shaped section 138 that is substantially rectangular and that extends outward along the four side edges of an outer wall surface 136*b*, which is on the side opposite from that of the arrangement surface 136*a* where the nozzle rows N are provided, is formed integrally with the outer wall surface 136*b*. The brim-shaped section 138 is a guide member that allows the nozzle row unit 136 incorporated onto the carriage 28 to be slidably guided along the carriage 28 surface. That is, each nozzle row unit 136 is mounted by passing it through a rectangular opening section 128, which is formed in the carriage 28 surface, with a gap between them, so that the arrangement surface 136*a* where the nozzle rows N are formed comes in opposition to the platen 26. At this time, the brim-shaped section 138 is in contact with and engages the four circumferential sections of the rectangular opening section 128. It should be noted that the outer wall surface 136*b* having the brim-shaped section 138 is in surface contact with a plate member 139 fixed to the carriage 28 surface by screws 139*a*, and thus is pressed against the surface of the carriage 28. Consequently, on the carriage 28 surface, the nozzle row units 136 are restricted from separating from the surface, and at the same time, the nozzle row units 136 are slidably movable in the main-scanning direction and the sub-scanning direction by an expected position-adjustment amount.

The nozzle row units 136 are also provided with adjusting and holding mechanisms 140 and 142 for adjusting the amount of sliding movement and also for fixably holding the nozzle row units 136 at the position after that adjustment has been made. The adjusting and holding mechanisms 140 and 142 are provided in the main-scanning direction and in the sub-scanning direction, respectively.

The adjusting and holding mechanism 140 in the sub-scanning direction is made of a pair of left and right first eccentric cams 140*a* and 140*a* provided in contact with the lower end surface of the brim-shaped section 138, and a first spring member 140*b* such as a plate spring that is in contact with the upper end surface of the brim-shaped section 138 and that presses the nozzle row unit 136 against the first eccentric cams 140*a*. On the other hand, the adjusting and holding mechanism 142 in the main-scanning direction is made of one second eccentric cam 142*a* provided in contact with the right end surface of the brim-shaped section 138, and a second spring member 142*b* that is in contact with the left end surface of the brim-shaped section 138 and that presses the nozzle row unit 136 against the second eccentric cam 142*a*.

The position of the nozzle row unit 136 in the sub-scanning direction and its tilt in the sub-scanning direction is adjusted by rotating the first eccentric cams 140*a* to adjust the amount of push in the sub-scanning direction. That is, if the amount of push by the pair of left and right first eccentric cams 140*a* is altered by a same amount, then the nozzle row unit 136 can be moved forward (or backward) parallel to the sub-scanning direction, and if the amount of push is made different between the two, then the orientation of the nozzle row unit 136 can be tilted by the amount of that difference. Also, the nozzle row unit 136 can be moved forward (or backward) parallel to the main-scanning direction so as to adjust its position in the main-scanning direction by rotating the second eccentric cam 142*a* to adjust the amount of push in the main-scanning direction.

It should be noted that, in order to rotate the first and the second eccentric cams 140*a* and 142*a*, a force larger than the elastic force of the first and the second spring members 140*b* and 142*b* is required. Consequently, although the first and the second eccentric cams 140*a* and 142*a* are pressed against the spring members 140*b* and 142*b* via the nozzle row unit 136, they are not rotated due to the elastic force of the spring members 140*b* and 142*b*.

===Driving the Print Heads===

The driving of the print heads 36 is described with reference to FIG. 6.

Figure 6:
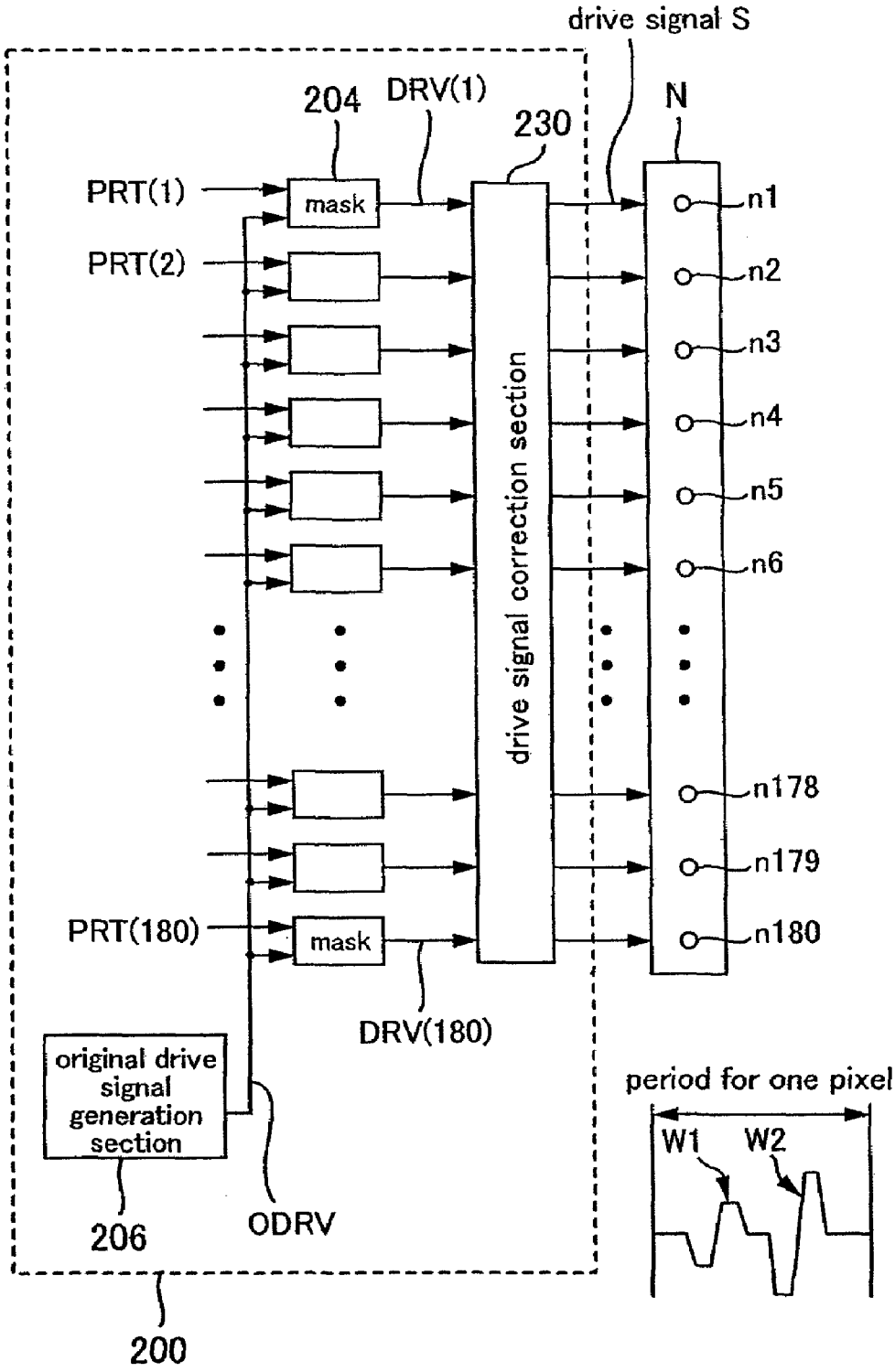
FIG. 6 is a diagram showing a configuration of a drive signal generation section provided in a head control unit.
Figure 7:
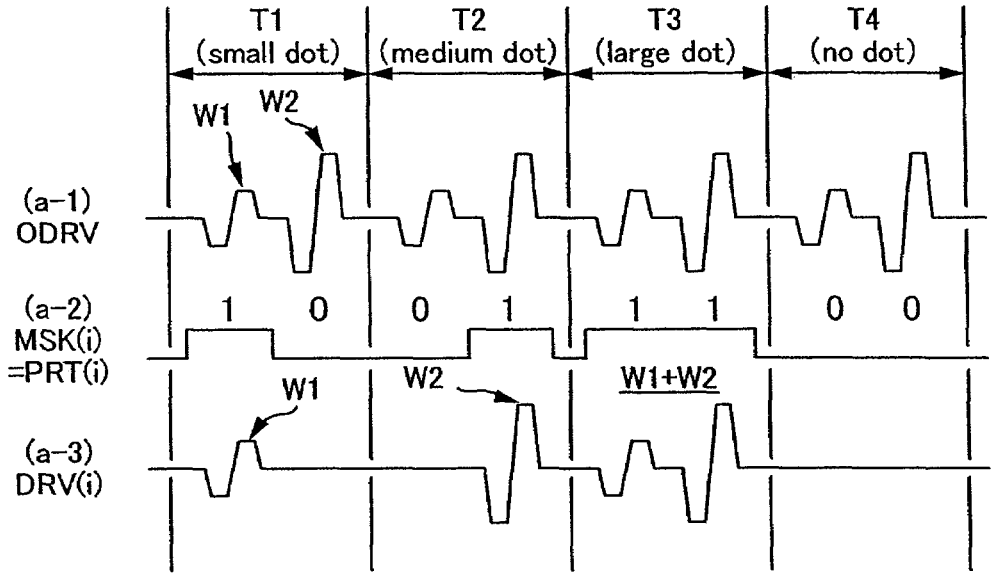
FIG. 7 is a timing chart showing the operation of the drive signal generation section.
Figure 8:
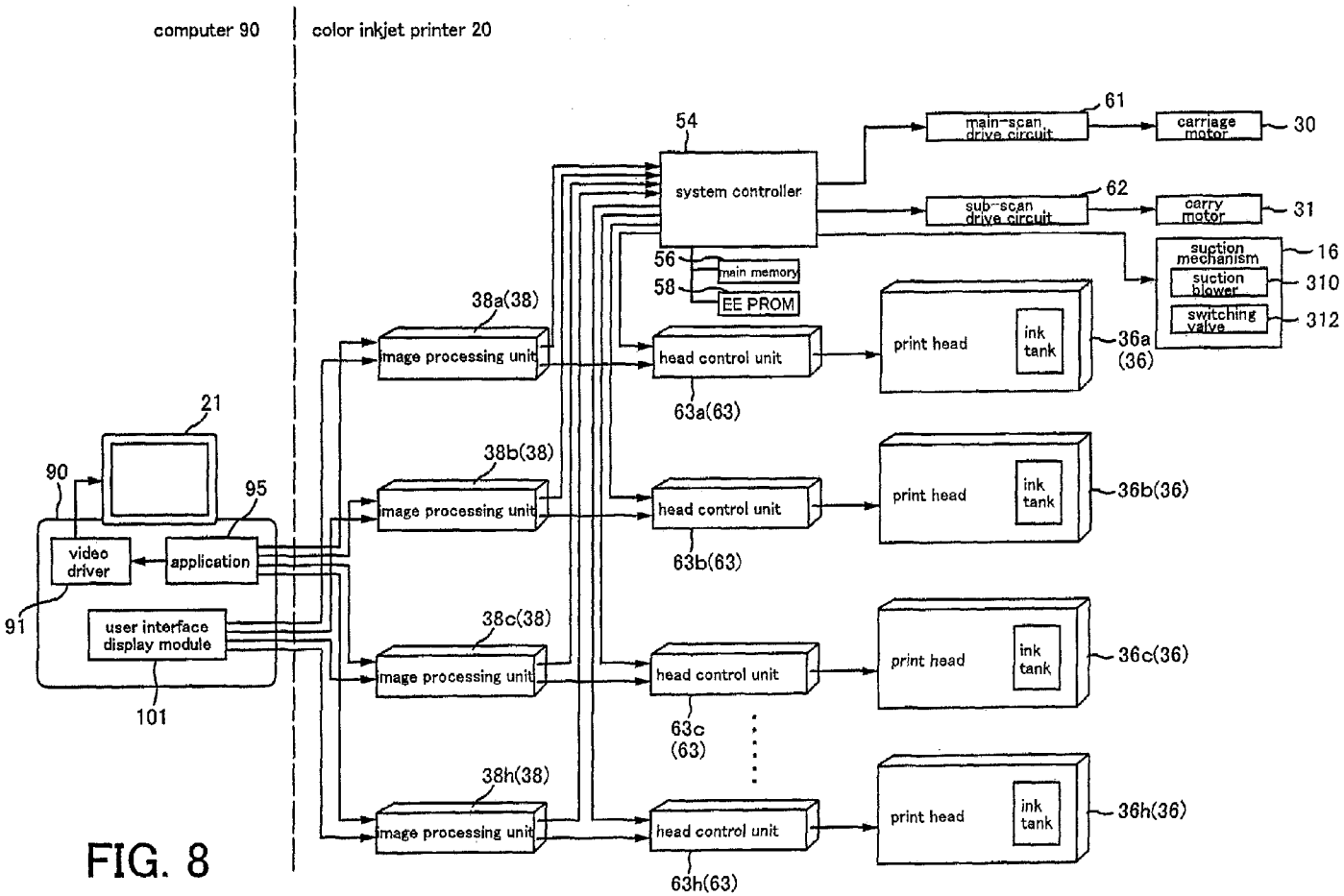
FIG. 8 is a block diagram showing a configuration of a print system provided with the color printer.

FIG. 6 is a block diagram showing the configuration of a drive signal generation section provided in a head control drive unit 63 (FIG. 8). FIG. 7 is a timing chart for an original signal ODRV, a print signal PRT(i), and a drive signal DRV(i), which indicate the operation of the drive signal generation section.

In FIG. 6, a drive signal generation section 200 is provided with a plurality of mask circuits 204, an original drive signal generation section 206, and a drive signal correction section 230. The mask circuits 204 are provided corresponding to each of the plurality of piezoelectric elements for driving each of the nozzles n1 to n180 of the print head 36. It should be noted that in FIG. 6, the number in parentheses at the end of the name of each of the signals indicates the number of the nozzle to which that signal is supplied.

The original drive signal generation section 206 generates an original drive signal ODRV that is used in common by the nozzles n1 to n180. The original drive signal ODRV is a signal that includes two pulses, a first pulse W1 and a second pulse W2, during the main scanning period of one pixel.

The drive signal correction section 230 performs correction by shifting the timing of the drive signal waveform, which has been shaped by the mask circuits 204, either forward or backward over the entire return pass. By correcting the timing of the drive signal waveform, discrepancies in the positions where ink droplets land in the forward pass and the return pass are corrected, that is, discrepancies in the positions where dots are formed in the forward and return passes are corrected.

As shown in FIG. 6, serial print signals PRT(i) that are received are input to the mask circuits 204 together with the original drive signal ODRV that is output from the original drive signal generation section 206. The serial print signals PRT(i) are serial signals having two bits per pixel, and each of the bits corresponds to the first pulse W1 and the second pulse W2, respectively. The mask circuits 204 are gates for masking the original drive signal ODRV depending on the level of the serial print signals PRT(i). More specifically, when a serial print signal PRT(i) is at level 1, the mask circuit 204 allows the pulses corresponding to the original signal ODRV to pass through and supplies them to the piezoelectric element as the drive signal DRV. On the other hand, when a serial print signal PRT(i) is at level 0, then the mask circuit 204 blocks the pulses corresponding to the original drive signal ODRV.

As shown in FIG. 7, the original drive signal ODRV generates a first pulse W1 and a second pulse W2 alternately during each period for one pixel T1, T2, T3, and T4. It should be noted that "period for one pixel" has the same meaning as the main-scanning period of one pixel. Then, as shown in the diagram, when the print signal PRT(i) corresponds to the two bits of pixel data "1,0", only the first pulse W1 is output in the first half of the pixel period. Accordingly, a small ink droplet is ejected from the nozzle, forming a small-sized dot (small dot) on the print paper. When the print signal PRT(i) corresponds to the two bits of pixel data "0,1" then only the second pulse W2 is output in the second half of the pixel period. Accordingly, a medium-sized ink droplet is ejected from the nozzle, forming a medium-sized dot (medium dot) on the print paper. When the print signal PRT (i) corresponds to the two bits of pixel data "1,1" then both the first pulse W1 and the second pulse W2 are output during the pixel period. Accordingly, a large ink droplet is ejected from the nozzle, forming a large-sized dot (large dot) on the print paper. Also, when the print signal PRT(i) corresponds to the two bits of pixel data "0,0" then neither the first pulse W1 or the second pulse W2 are output during the pixel period. In this case, an ink droplet is not ejected from the nozzle, and a dot is not formed on the print paper.

As described above, the drive signal DRV(i) in a single pixel period is shaped so that it may have four different waveforms corresponding to the four different values of the print signal PRT(i), and based on these signals, the print head 36 can either form dots of three different sizes or can not form dots at all.

===Example Configuration of the Controls of the Liquid Ejecting Apparatus===

Figure 9:
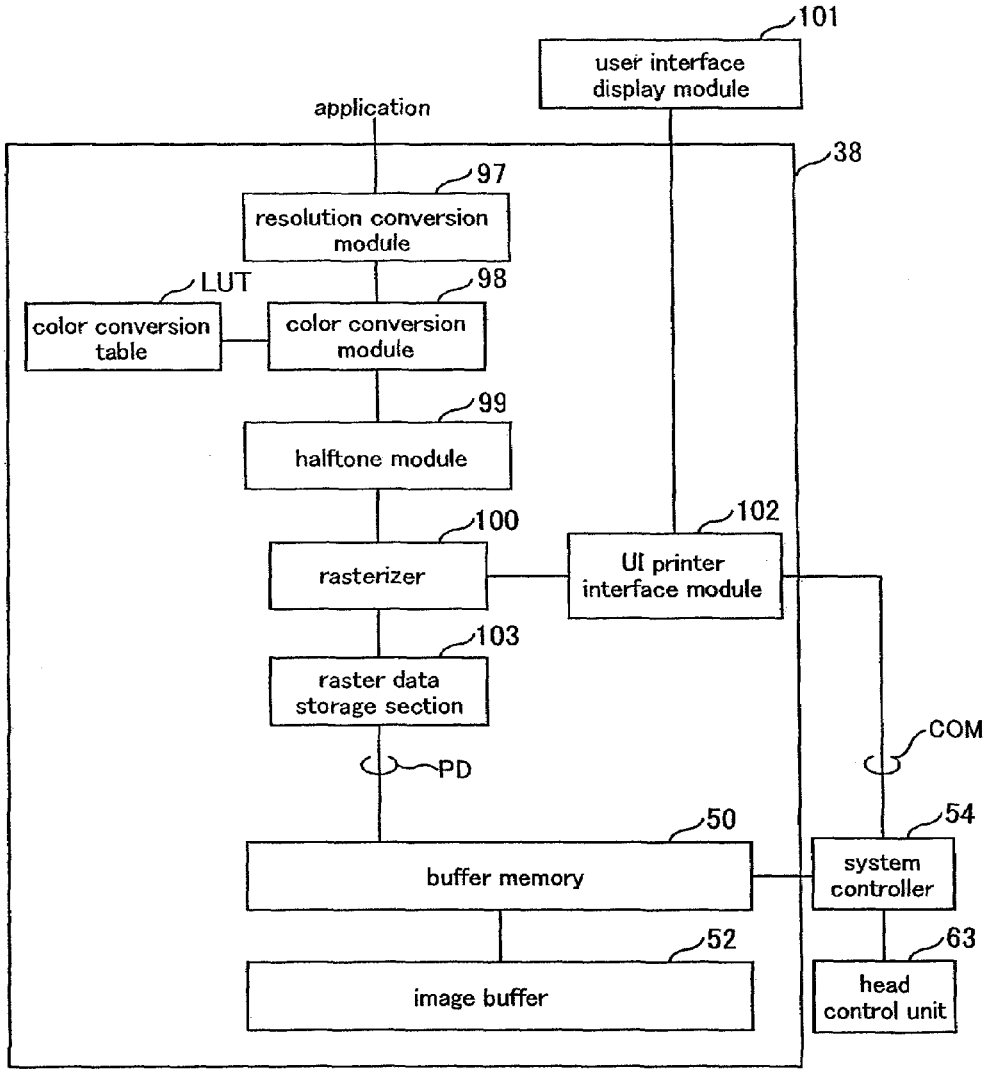
FIG. 9 is a block diagram showing a configuration of an image processing unit.

An example of the configuration of the controls of the color printer 20 serving as the liquid ejecting apparatus is described next with reference to FIG. 8 and FIG. 9. FIG. 8 is a block diagram showing the configuration of the control of the color printer 20. FIG. 9 is a block diagram showing the configuration of an image processing unit 38.

The color inkjet printer 20 is used connected to a computer 90 such as a personal computer and prints a print image on the roll paper P based on image data sent from the computer 90. It should be noted that the above configuration in which the computer 90 has been added to the color inkjet printer 20 can also be broadly defined as a "liquid ejecting apparatus."

The computer 90 is provided with a display device such as a CRT 21 or a liquid crystal display device, which is not shown, input devices such as a keyboard and a mouse, and a drive device such as a flexible drive device or a CD-ROM drive device. Also, in the computer 90, an application program 95 operates under a predetermined operating system. The operating system incorporates a video driver 91, and the application program 95, which is for retouching images, for example, carries out desired processing with respect to images to be processed, and displays images on the CRT 21 via the video driver 91.

The color printer 20 is provided with image processing units 38 as information generating means to which image data from the application program 95, for example, are input, a system controller 54 for controlling the overall operation of the color printer 20, a main memory 56, and an EEPROM 58. The system controller 54 is connected to a main-scan drive circuit 61 for driving the carriage motor 30, a sub-scan drive circuit 62 for driving the carry motor 31, and eight head control units 63 provided in correspondence with each of the print heads 36 and which serve as control means for controlling the print heads 36.

When the application program 95 issues a print command, the image processing unit 38 provided in the color printer 20 receives image data from the application program 95 and converts these into print data PD. As shown in FIG. 9, each image processing unit 38 is internally provided with a resolution conversion module 97, a color conversion module 98, a halftone module 99, a rasterizer 100, a UI printer interface module 102, a raster data storage section 103, a color conversion lookup table LUT, a buffer memory 50, and an image buffer 52.

The resolution conversion module 97 serves to convert the resolution of the color image data formed by the application program 95 to a corresponding print resolution based on information such as the print mode that is received together with the image data. The image data whose resolution has been thus converted at this point is still image information made of the three color components RGB. The color conversion module 98 references the color conversion lookup table LUT and, for each pixel, converts the RGB image data into multi-gradation data of a plurality of ink colors that can be used by the color inkjet printer 20.

The multi-gradation data that have been color converted have a gradation value of 256 levels, for example. The halftone module 99 executes so-called halftone processing to generate halftone image data. Here, for example, "half toning" is done by dividing an image into regions each made up of a plurality of portions (a pixel can be formed in each of these portions), and expressing the darkness of each region by whether or not to form either a large dot, a medium dot, or a small dot in each of the portions that make up that region. Therefore, in the halftone image data, data for each pixel is expressed as binary data indicating the level of gradation of each pixel.

The halftone image data are rearranged into a desired data order by the rasterizer 100, and are output to the raster data storage section 103 as the final print data PD. These print data PD include raster data that indicate how dots are formed in each main scan and data indicating the sub-scan feed amount.

On the other hand, the user interface display module 101 provided in the computer 90 has the function of displaying various types of user interface windows related to printing and the function of receiving input from the user through these windows. For example, a user could designate the type and size of the print paper, or the print mode, for example, through the user interface display module 101.

The UI printer interface module 102 has the function as an interface between the user interface display module 101 and the color printer 20. It interprets instructions given by the user through the user interface and sends various commands COM to the system controller 54, for example, or conversely, it interprets commands COM received from the system controller 54, for example, and executes various displays on the user interface. For example, the above instruction regarding the type or the size of the print paper, for example, that is received by the user interface display module 101 is sent to the UI printer interface module 102, which interprets this instruction and sends a command COM to the system controller 54.

The UI printer interface module 102 also functions as a print mode setting section. That is, the UI printer interface module 102 determines the print mode, which is the recording mode, based on print information received by the user interface display module 101, that is, information on the resolution of the image to be printed and the nozzles that are used for printing, and information on the data indicating the sub-scan feed amount, for example, and print data PD corresponding to this print mode are generated by the halftone module 99 and the rasterizer 100 and output to the raster data storage section 103.

The print data PD output to the raster data storage section 103 are temporarily held in the buffer memory 50 and then converted into data corresponding to each nozzle and stored in the image buffer 52. The system controller 54 of the color printer 20 controls the main-scan drive circuit 61, the sub-scan drive circuit 62, and the head control units 63, for example, based on the information of the commands COM that are output by the UI printer interface module 102, so as to drive the nozzles for each color provided in each print head 36 based on the data of the image buffer 52 to carry out printing. Here, examples of the print mode include a high-quality mode in which dots are recorded using a so-called interlace mode, and a high-speed mode in which dots are recorded without using this interlace mode.

===Operation of the Liquid Ejecting Apparatus===

Figure 10:
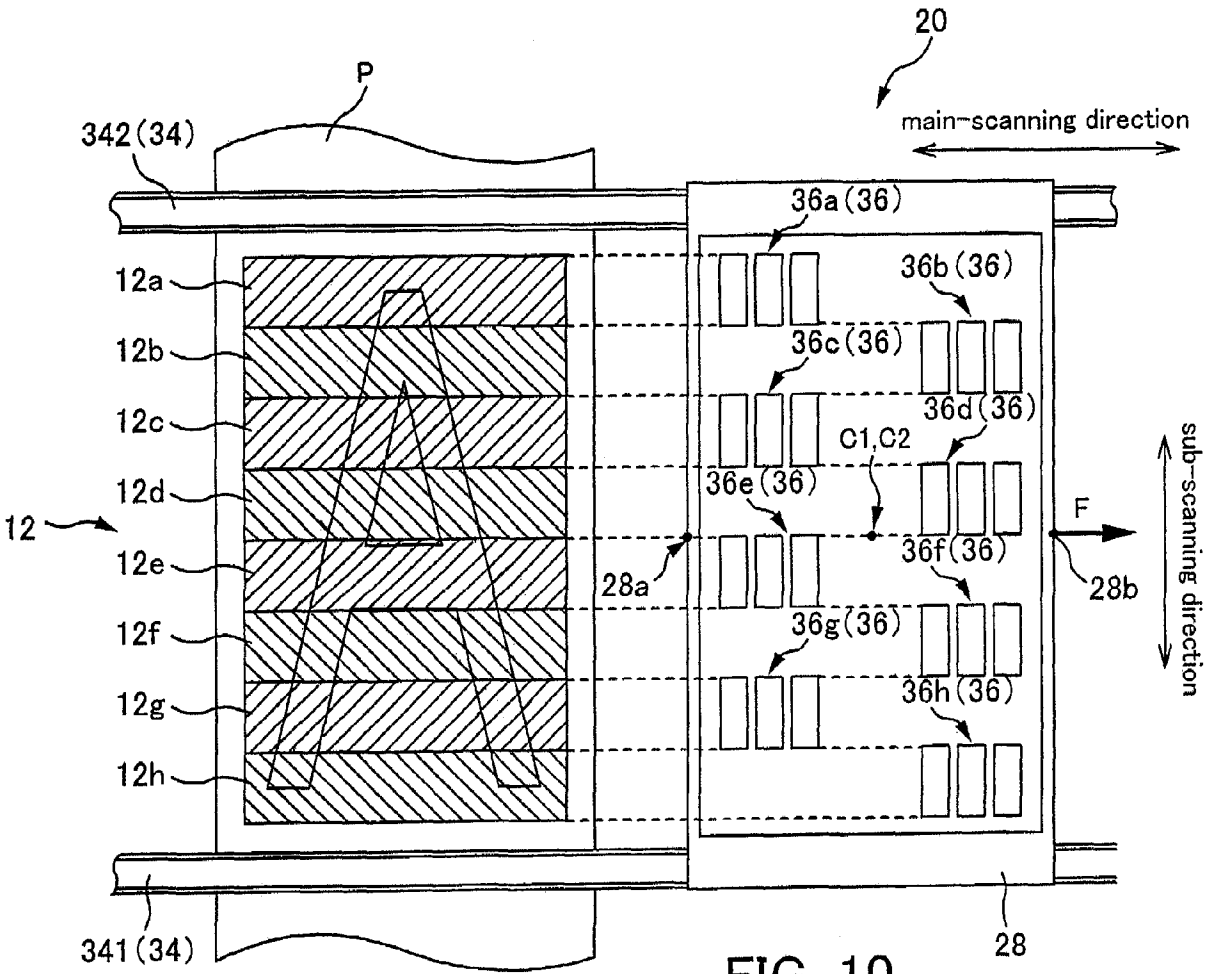
FIG. 10 is an explanatory diagram for describing a printing operation of the color printer.

FIG. 10 is an explanatory diagram for describing the printing operation of the color printer 20 serving as the liquid ejecting apparatus described above. Here, as an example of the printing operation, an example will be described in which the eight print heads 36 of the carriage 28 are used to print a single print image "A" on the roll paper P. It should be noted that the size of this print image "A" in the sub-scanning direction is substantially eight times the head length H of the print heads 36, as shown in the diagram, and the eight print heads 36 are used as if they constitute a single print head, so as to print the print image "A" 12 in a single scan of the carriage 28.

That is, the print image "A" 12 is divided into eight band-shaped images 12*a*, 12*b*, . . . 12*h* in the sub-scanning direction, and these band-shaped images are printed in a continuum in which there are no gaps or overlapping areas between adjacent band-shaped images above and below one another in the sub-scanning direction. Each band-shaped image is printed by the print head 36 corresponding to that band-shaped image. More specifically, instructions are given so that the top print head 36*a* in the sub-scanning direction is used to print the top band-shaped image 12*a* in the sub-scanning direction, the second print head 36*b* from the top is used to print the second band-shaped image 12*b* from the top, and thereafter, the third through eighth print heads 36*c*, 36*d*, . . . 36*h* are used to print the corresponding third through eighth band-shaped images 12*c*, 12*d*, . . . 12*h*, respectively.

The instructions that are received by the user interface display module 101 are sent to the UI printer interface module 102 provided in the aforementioned eight print processing units 38*a*, 38*b*, . . . 38*h*, and the UI printer interface module 102 interprets the commands that have been made and sends commands COM to the system controller 54.

Next, the user makes an instruction to carry out printing through the application program 95, for example. The application program 95 receives this instruction and issues a print command. Then, the aforementioned eight image processing units 38*a*, 38*b*, . . . 38*h* receive image data corresponding to the print image "A" 12 that has been equally divided into the eight band-shaped images 12*a*, 12*b*, . . . 12*h* from the application program 95, convert these into print data PD, and transmit them to the buffer memory 50. The image processing units 38*a*, 38*b*, . . . 38*h* transmit the print data PD corresponding to the print heads 36*a*, 36*b*, . . . 36*h*, respectively, to the image buffer 52 after the print data PD have been received by the buffer memory 50.

Also, the image processing units 38*a*, 38*b*, . . . 38*h* transmit the above commands COM to the system controller 54. The system controller 54 sends control signals to the main-scan drive circuit 61, the sub-scan drive circuit 62, and the above-mentioned eight head control units 63*a*, 63*b*, . . . 63*h* based on the information received from each of the image processing units 38*a*, 38*b*, . . . 38*h*.

The head control units 63*a*, 63*b*, . . . 63*h* read print data for each color component from the image buffer 52 in the image processing units 38*a*, 38*b*, . . . 38*h* corresponding to the head control units 63, respectively, in accordance with the control signals from the system controller 54. Then, the head control units 63*a*, 63*b*, . . . 63*h* control the corresponding print heads 36*a*, 36*b*, . . . 36*h*, respectively, based on the data that have been read.

Then, the main-scan drive circuit 61 controls the carriage motor 30 to move the carriage 28 in the main-scanning direction, and ink is ejected from the print heads 36*a*, 36*b*, . . . 36*h* controlled by the print head control units 63*a*, 63*b*, . . . 63*h*, respectively, to print the print image "A" 12 on the roll paper P.

However, the band-shaped images 12*a*, 12*b*, . . . 12*h* of the print image 12 are made of numerous dot rows formed by ejecting ink droplets from the plurality of nozzle rows N. For this reason, it is not possible to draw an attractive print image on the roll paper P if the positions where these dot rows are formed deviate from expected design positions.

One factor that causes the positions where dot rows are formed to deviate from the design positions is the precision of the position of the nozzle rows N in the main-scanning direction and the sub-scanning direction. In particular, in this embodiment, eight print heads 36 are provided, and therefore, if the orientation of the nozzle rows N and their relative positions in the main-scanning direction and in the sub-scanning direction are not coordinated among the eight print heads 36 on the carriage 28, then it is not possible to coordinate the print positions among the band-shaped images 12*a*, 12*b*, . . . 12*h*, and thus the print image "A" formed as an assembly of the eight band-shaped images is not printed attractively. For example, if the orientation (direction) of the nozzle rows N is not parallel in the sub-scanning direction for all eight print heads 36, then the orientation of the dot rows are that are formed by the nozzle rows N will be different among the band-shaped images, and thus the image will be non-continuous at, for example, the boundary areas between the band-shaped images. Also, if the relative positions in the main-scanning direction of the nozzle rows N of the print heads 36 are not in accordance with the design positions shown in FIG. 3, then the positions where the dot rows are formed are deviated in the main-scanning direction for each print head 36, and thus the image becomes non-continuous at, for example, the boundary areas between the band-shaped images. Moreover, if the relative positions in the sub-scanning direction are not in accordance with the design positions shown in FIG. 3, then the positions where the dot rows are formed are deviated in the sub-scanning direction for each print head 36, and thus non-printed areas that are blank or areas in which the images overlap one another occur at, for example, the boundary areas between the band-shaped images, resulting in a non-continuous image.

Consequently, in the present invention, the adjusting and holding mechanisms 140 and 142 of the nozzle row units 136 perform position adjustment as discussed below for each nozzle row unit 136 in order so that the relative positions, for example, of the print heads 36 are coordinated.

===Position Adjustment of the Print Head Nozzle Row Units===

The basic concept of the method for adjusting the positions of the nozzle row units 136 is described with reference to FIG. 3. It should be noted that "position adjustment of the nozzle row units 136" means to adjust the positions of the nozzle row units 136 in the main-scanning direction and in the sub-scanning direction on the carriage 28, and also means to adjust their orientation so that their orientation is aligned in the sub-scanning direction. More specifically, it refers to taking a single predetermined nozzle row unit 136*s* as a reference and performing adjustment so that the position of a nozzle row unit 136 to be adjusted matches the design position shown in FIG. 3, taking that reference nozzle row unit 136*s* as a reference. For example, the relative position in the main-scanning direction and the sub-scanning direction from the reference nozzle row unit 136*s* is set so that it is distanced from the reference nozzle row unit 136*s* by the design pitch Wh and L0, and the orientation of that nozzle row unit 136 is made parallel with the reference nozzle row unit 136*s*.

In the present invention, the nozzle row unit 136*s* arranged closest to the line of action of the pull force F of the pull belt 32, which is the moving force of the carriage 28, is taken as the nozzle row unit 136*s* that serves as a reference for position adjustment. That is, in the example of FIG. 3, either one of the nozzle row units 136*s* provided in the print head 36*d* or the print head 36*e* is taken as the reference.

The reason for this is because the pull force F is more directly transmitted to the area on the side close to the line of action in the carriage 28, and thus vibration during movement of the carriage 28 is small, and as a result, the amount of deviation in the dot formation positions, that is, the deviation, due to vibration, in the positions where ink droplets ejected toward the roll paper P land during the carriage movement is smaller the closer the nozzle row unit 136*s* is to the line of action. Also, it becomes possible to correctly coordinate the dot-row formation positions among the nozzle row units 136 if the positions of the other nozzle row units 136 are adjusted with reference to this reference nozzle row unit 136*s*, in which there is little deviation in dot formation positions.

It should be noted that as shown in the diagrammed example, if there are a plurality of nozzle row units 136*s*, such as six, that are closest to the line of action, then the nozzle row unit 136*bs* that is arranged closest to the center point between the pair of engaging sections 28*a* and 28*b*, which are the pair of the points of action of the pull force F, are taken as the reference.

The reason for this is because, while the carriage 28 moves back and forth, the area where the vibration is, on average, smallest is the center point between the pair of points of action 28*a* and 28*b*. In the case of the present embodiment, this center point corresponds to the surface center C1 of the carriage 28, and therefore, the nozzle row unit 136*bs* that is arranged closest to the surface center C1 is taken as a reference for adjusting the positions of the other nozzle row units 136. It should be noted that in the diagrammed example, there is one nozzle row unit 136*bs* that meets the above condition in both the print heads 36*d* and 36*e*, and in this case, either of these nozzle row units 136*bs* can be taken as the reference. In the following description, the nozzle row unit 136*bs* of the print head 36*d* has been selected as the reference.

The method for adjusting the positions of the nozzle row units 136 is described in detail below with reference to FIGS. 11 to 18. It should be noted that in all diagrams of FIG. 11 to FIG. 18, the diagrams appended with "A" (i.e., FIG. 11A, FIG. 12A, FIG. 13A, FIG. 14A, FIG. 15A, FIG. 16A, FIG. 17A, and FIG. 18A) show the surface arrangement of the nozzle row units on the carriage 28, and the diagrams appended with "B" (i.e., FIG. 11B, FIG. 12B, FIG. 13B, FIG. 14B, FIG. 15B, FIG. 16B, FIG. 17B, and FIG. 18B) either show horizontal ruled lines, or show the dot rows created on the roll paper P by ink droplets ejected from those nozzle row units.

---(1) Position Adjustment of the Reference Nozzle Row Unit---

Figure 11A:
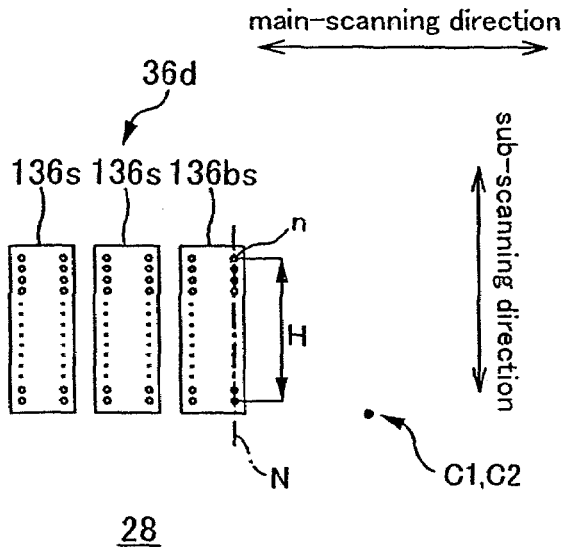
FIGS. 11A and 11B are explanatory diagrams for describing a method for adjusting the positions of the nozzle row units.
Figure 11B:
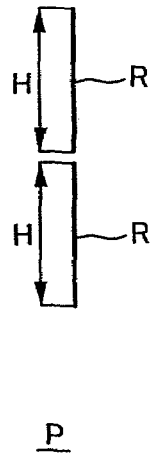

First, adjustment for making the orientation of the reference nozzle row unit 136*bs* parallel to the sub-scanning direction is performed. As regards this adjustment procedure, first, as shown in FIG. 11A, ink droplets are ejected toward the roll paper P from one of the two nozzle rows N provided in the reference nozzle row unit 136*bs*, forming a dot row R (the upper dot row in FIG. 11B) as shown in FIG. 11B. It should be noted that it is preferable that, of the two rows, the row that is closer to the center point is selected as the nozzle row N that forms this dot row R.

Next, the paper is fed in the sub-scanning direction by an amount that is substantially equal to the head length H, and ink droplets are once again ejected from the same nozzle row N to form a dot row R (the lower dot row in FIG. 11B).

Figure 12A:
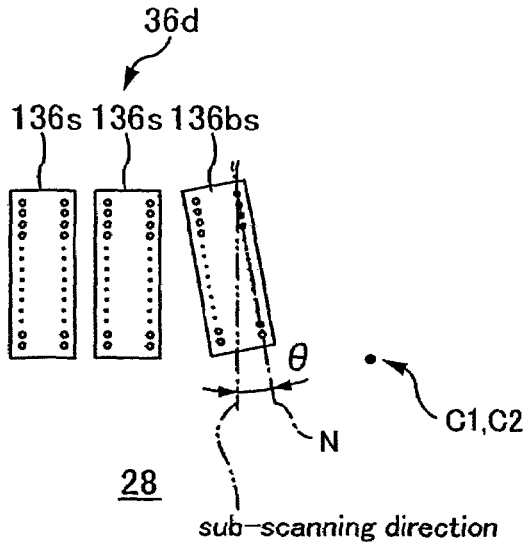
FIGS. 12A and 12B are explanatory diagrams for describing a method for adjusting the positions of the nozzle row units.
Figure 12B:
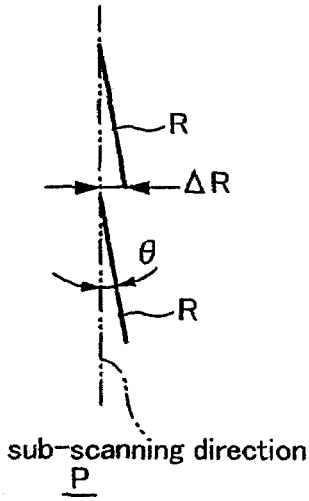

Here, as shown in FIG. 11A, if the orientation of the nozzle row N of the reference nozzle row unit 136*bs* is parallel to the sub-scanning direction, then as shown in FIG. 11B, the two dot rows R fall on a straight line. However, if the orientation is tilted as shown in FIG. 12A, then, as shown in FIG. 12B, this tilting becomes noticeable as the amount of position discrepancy AR between the two dot rows R. That is, a tilt angle θ with respect to the sub-scanning direction (i.e., the angle θ by which the reference nozzle row unit 136*bs* is tilted with respect to the sub-scanning direction) is expressed as the amount of position discrepancy ΔR in the main-scanning direction between the lower end of one dot row R and the upper end of the other dot row R. Then, the amount of position discrepancy ΔR becomes the amount to adjust the tilt of the reference nozzle row unit 136*bs*. Consequently, the pair of first eccentric cams 140*a* and 140*a* shown in FIG. 5 are rotated with a difference between them of the amount of position discrepancy ΔR, making the orientation of the reference nozzle row unit 136*bs* parallel to the sub-scanning direction.

---(2) Position Adjustment of the Other Nozzle Row Units---

Once the orientation of the reference nozzle row unit 136*bs* has been aligned with the sub-scanning direction in this way, it can be taken as a reference for adjusting the positions of the other nozzle row units 136. Position adjustment of the other nozzle row units 136 can be broadly classified into three types of adjustments: adjustment of tilt with respect to the reference nozzle row unit 136*bs*; adjustment of the relative position in the main-scanning direction with respect to the reference nozzle row unit 136*bs*; and adjustment of the relative position in the sub-scanning direction with respect to the reference nozzle row unit 136*bs*. Here, the example that is described is a case where the nozzle row unit 136 of the print head 36*c* (in the diagram, the nozzle row unit on the right end), which is positioned diagonally above the reference nozzle row unit 136*bs* shown in FIG. 3, is adjusted.

(A) Adjusting Tilt of the Nozzle Row Unit

First, the orientation of the nozzle row unit 136 that is targeted for adjustment is adjusted so that it becomes parallel to the reference nozzle row unit 136*bs*. More specifically, first, as shown in FIG. 13A, ink droplets are ejected toward the roll paper P from one nozzle row N of the reference nozzle row unit 136*bs* to form a reference dot row Rs as shown in FIG. 13B. Then, movement of the carriage 28 and feeding of the paper are carried out appropriately, and then, ink droplets are ejected from one nozzle row N of the nozzle row unit 136 targeted for adjustment next to the reference dot row Rs in the sub-scanning direction, forming a dot row R.

Here, if, as shown in FIG. 13A, the orientation of the nozzle row unit 136 is aligned parallel to the reference nozzle row unit 136*bs*, then, as shown in FIG. 13B, the two dot rows Rs and R will be parallel. That is, an upper end spacing ΔRu and a lower end spacing ΔRd between the two dot rows Rs and R are equal. However, if there is tilting as shown in FIG. 14A, then that tilt angle θ is visible as the deviation (=ΔRu−ΔRd) between the upper end spacing ΔRu and the lower end spacing ΔRd between the two dot rows Rs and R, as shown in FIG. 14B. This deviation (=ΔRu−ΔRd) serves as the amount by which the tilt in the nozzle row unit 136, which is targeted for adjustment, is to be adjusted. Consequently, the pair of first eccentric cams 140*a* and 140*a* shown in FIG. 5 are rotated, with a difference between them of the amount of this discrepancy, so as to align the orientation of the nozzle row unit 136.

(B) Adjustment of the Relative Position in the Sub-Scanning Direction of Nozzle Row Units Next, adjustment is performed so that the relative position in the sub-scanning direction of the nozzle row units 136 is in accordance with the design position. That is, as shown in FIG. 15A, a nozzle row unit 136 to be adjusted is set to a position that is distanced from the reference nozzle row unit 136*bs* in the sub-scanning direction by the design pitch L0.

More specifically, first, as shown in FIG. 15A, the carriage 28 is moved in the main-scanning direction as ink droplets are ejected toward the roll paper P from an upper end nozzle n of a nozzle row N of the reference nozzle row unit 136*bs* and from an upper end nozzle n of a nozzle row N of the nozzle row unit 136 to be adjusted, thereby forming a pair of ruled lines Ks and K in the main-scanning direction (hereinafter, referred to as "horizontal ruled lines") as shown in FIG. 15B. It should be noted that the horizontal ruled line Ks is formed by the nozzle n of the reference nozzle row unit 136*bs* and the horizontal ruled line K is formed by the nozzle n of the nozzle row unit 136 to be adjusted.

Here, as shown in FIG. 15A, if the nozzle row unit 136 to be adjusted is positioned distanced from the reference nozzle row unit 136*bs* in the sub-scanning direction by the design pitch L0 as intended, then the spacing L between the horizontal ruled lines Ks and K is equal to the design pitch L0. However, as shown in FIG. 16A, if the relative position of the nozzle row unit 136 to be adjusted is deviated from the design position, then this position deviation becomes visible as the discrepancy ΔL (=L−L0) between the spacing L, which is the distance between the horizontal ruled lines Ks and K, and the design pitch L0. This discrepancy ΔL is the amount by which the nozzle row unit 136, which is targeted for adjustment, is to be adjusted in the sub-scanning direction, and the pair of first eccentric cams 140*a* and 140*a* shown in FIG. 5 are rotated by the amount of this discrepancy ΔL, to adjust the relative position of the nozzle row unit 136 to be adjusted in the sub-scanning direction.

(C) Adjustment of the Relative Position in the Main-Scanning Direction of Nozzle Row Units Next, adjustment is performed so that the relative position in the main-scanning direction of the nozzle row units 136 is in accordance with the design position. That is, as shown in FIG. 17A, a nozzle row unit 136 to be adjusted is set to a position that is distanced from the reference nozzle row unit 136*bs* in the main-scanning direction by the design pitch Wh.

More specifically, first, as shown in FIG. 17A, ink droplets are ejected toward the roll paper P from a nozzle row N of the reference nozzle row unit 136*bs* and from a nozzle row N of the nozzle row unit 136 to be adjusted, thereby forming a reference dot row Rs and a dot row R to be adjusted as shown in FIG. 17B. Here, as shown in FIG. 17A, if the nozzle row unit 136 to be adjusted is positioned distanced from the reference nozzle row unit 136*bs* in the main-scanning direction by the design pitch Wh as intended, then the spacing W between the two dot rows Rs and R shown in FIG. 17B is equal to the design pitch Wh. However, as shown in FIG. 18A, if the relative position of the nozzle row unit 136 to be adjusted is deviated from the design position, then as shown in FIG. 18B, this position deviation becomes noticeable as the discrepancy ΔW (=W−Wh) between the spacing W, which is the distance between the two dot rows Rs and R, and the design pitch Wh. This discrepancy ΔW is the amount by which the position of the nozzle row unit 136, which is targeted for adjustment, is to be adjusted in the main-scanning direction, and the second eccentric cam 142*a* shown in FIG. 5 is rotated by the amount of this discrepancy ΔW to adjust the relative position of the nozzle row unit 136 to be adjusted in the main-scanning direction.

It should be noted that the dot rows R and Rs and the horizontal ruled lines K and Ks for position adjustment are made of numerous dots, and it is preferable that the size of these dots is very close to the size actually used, that is, set to a size that is practically used with high frequency. This is because the amount of ink droplets changes according to the dot size, and there are cases in which changes in the ink droplet amount result in changes in, for example, the ejection velocity in correspondence with the ink droplet amount, thereby resulting in slight changes in the dot formation positions, that is, the positions where the ink droplets land. For example, as discussed earlier, there are three dot sizes in the present embodiment: large, medium, and small. Therefore, it is preferable that medium dots or small dots, which are practically used with high frequency, are used rather than large dots. Also, in practical print images, deviations in the dot-row formation positions become readily apparent at highlight areas in the print image, and small dots are frequently used for highlight areas. Consequently, it is even more preferable that small dots are used to form the dot rows R and Rs and the horizontal ruled lines K and Ks.

An example of a case where the nozzle row unit 136 of the print head 36*c* is adjusted was discussed above to describe the procedure for adjusting the positions of other nozzle row units 136, but in addition to the nozzle row unit 136 described in this example, it is of course also possible to perform position adjustment using the same procedure with respect to nozzle row units 136 of the other print heads 36*a*, 36*b*, 36*e*, 36*f*, 36*g*, and 36*h*, and also with respect to the nozzle row unit 136*s* in the same print head 36*d* as the reference nozzle row unit 136*bs*. That is, as regards the nozzle row units 136 of other print heads, for example, the only difference is that the design pitch Wh, in the sub-scanning direction, between each nozzle row unit 136 for adjustment and the reference nozzle row unit 136*bs* is changed to Wh−2Wn, Wh−4Wn, 0, 2Wn, or 4Wn, and that the design pitch L0 therebetween in the main-scanning direction is changed to 2L0, 3L0, or 4L0. Thus, description thereof is omitted.

Other Embodiments

A liquid ejecting apparatus, for example, according to the present invention was described above through an embodiment thereof. However, the foregoing embodiment is for the purpose of elucidating the present invention and is not to be interpreted as limiting the present invention. The invention can of course be altered and improved without departing from the gist thereof and includes functional equivalents.

For example, the following embodiments are also included in the liquid ejecting apparatus according to the present invention. Technology such as that of the present embodiment can also be adopted for, for example, color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, or DNA chip manufacturing devices. Also, these methods and manufacturing methods are within the scope of application.

In the foregoing embodiment, ink such as dye ink or pigment ink was ejected from the nozzles n. However, the liquid that is ejected from the nozzles n is not limited to such inks. For example, it is also possible to eject, from the nozzles, liquid (including water) such as metallic materials, organic materials (in particular polymeric materials), magnetic materials, conductive materials, wiring materials, film forming materials, electronic ink, machining liquids, genetic solutions, and so forth. Savings in material, process steps, and costs can be achieved if such liquids are directly ejected toward a target object.

Figures 19A, 19B:
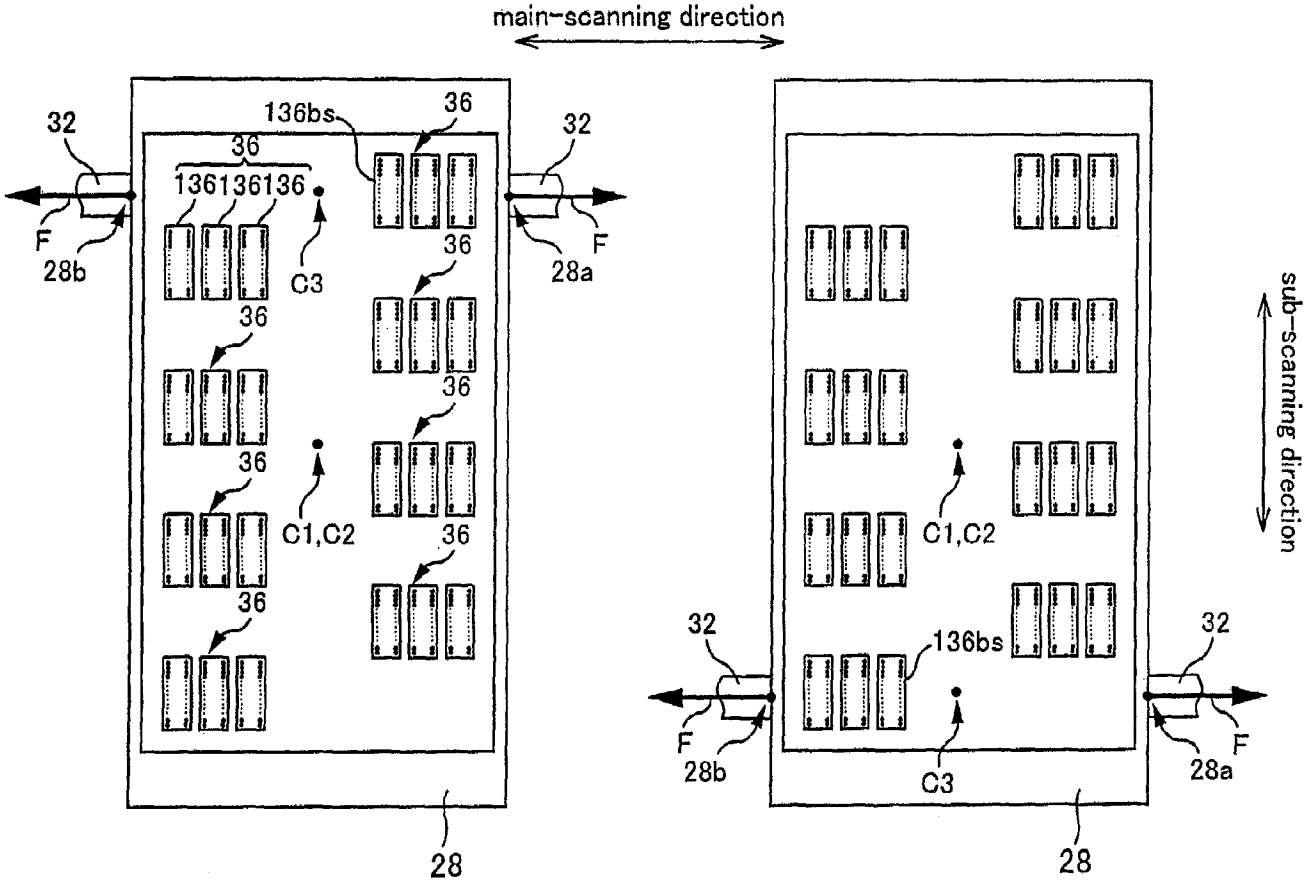
FIG. 19 is an explanatory diagram for describing another embodiment according to the present invention.

In the foregoing embodiment, the pair of engaging sections 28*a* and 28*b* for receiving the moving force F in the main-scanning direction were provided in the center of the carriage 28 in the sub-scanning direction. The position of the engaging sections 28*a* and 28*b*, however, is not limited to this, and it is for example also possible to provide them at end sections in the sub-scanning direction as shown in FIG. 19. It should be noted that FIG. 19A shows a configuration in which the engaging sections 28*a* and 28*b* are provided at the upper end section of the carriage 28, and FIG. 19B shows a configuration in which they are provided at the lower end section of the carriage 28. In both instances, however, the reference nozzle row unit 136*bs* that is taken as a reference for position adjustment is of course the nozzle row unit 136*bs* that is arranged closest to the center point C3 of the engaging sections 28*a* and 28*b*.

In the foregoing embodiment, an example was shown in which nozzle row units 136 provided with two nozzle rows N served as nozzle row groups, which are the smallest unit whose position on the carriage 28 is adjustable, but the number of nozzle rows N provided in the nozzle row units 136 is not limited to this. For example, it is also possible to provide only a single nozzle row N in the nozzle row units 136 so as to allow position adjustment in single row units, and moreover, it is also possible to provide six nozzle rows N, from the black nozzle row Nk to the yellow nozzle row Ny as shown in FIG. 2, in each nozzle row unit 136, so as to allow position adjustment in units of six rows. It should be noted that nozzle row units 136 having six nozzle rows would, of course, substantially be equivalent to the print heads 36.

In the foregoing embodiment, ink was ejected using piezoelectric elements. However, the method for ejecting liquid is not limited to this. Other methods, such as a method for generating bubbles in the nozzles using heat, may also be employed.

In the foregoing embodiment, roll paper P was described as an example of the print paper, but it is also possible to use A0 paper, for example, as the print paper.

In the foregoing embodiment, the nozzle row units 136, serving as nozzle row groups, that are the minimum unit for which individual position adjustment is possible are arranged in the sub-scanning direction with a spacing between them, but this is not a limitation. For example, it is also possible to dispose the nozzle row units 136 in succession without a spacing between them in the sub-scanning direction, so that the appearance is of eight nozzle row units 136 linked in a straight line in the sub-scanning direction. It should be noted that in this case, eight nozzle rows are linked in the sub-scanning direction, and while at first glance, it may appear as if there is a single nozzle row in the sub-scanning direction, but in actuality, the single row is made up of eight nozzle row units 136, thereby allowing independent position adjustment for each unit. Consequently, even for a nozzle row that appears to be a single unit, it is possible to take the nozzle row, among the eight nozzle rows making up this "single" row, that is arranged closest to the line of action as a reference for adjusting the positions of the other nozzle rows.

What is claimed is:

1. A liquid ejecting apparatus comprising:

a moving unit that moves by receiving a moving force;

a plurality of nozzle row units, each of said nozzle row units having nozzle rows for ejecting liquid onto a medium, each of said nozzle row units being respectively adjustable in its position on said moving unit, said nozzle row units being successively arranged at different positions, respectively, along a line extending in a direction that is perpendicular to a line of action of said moving force, said line of action being a line that passes through points upon which said moving force acts and being in a direction of said moving force; and a controller that controls said plurality of nozzle row units, said controller being configured to make a nozzle row unit that is arranged closer to said line of action of said moving force than any other nozzle row unit eject liquid to form dots rows for adjusting said nozzle row unit that is arranged closer to said line of action of said moving force than any other nozzle row unit as a reference, said controller being further configured to make said nozzle row unit that is arranged closer to said line of action of said moving force than any other nozzle row unit and a nozzle row unit that is arranged farther from said line of action than said nozzle row unit that is adjusted as said reference eject liquid to form dot rows for adjusting said nozzle row unit that is arranged farther from said line of action than said nozzle row unit that is adjusted as said reference with respect to said nozzle row unit which is adjusted as said reference.

2. A liquid ejecting apparatus according to claim 1, wherein said position of each of said nozzle row units is adjusted taking a nozzle row unit that is arranged closest to said line of action of said moving force as said reference.

3. A liquid ejecting apparatus according to claim 1, wherein:

said moving unit receives the moving force in opposite directions at a pair of points of action located on said line of action, and moves back and forth due to the moving force; and said position of each of said nozzle row units is adjusted taking a nozzle row unit, among a plurality of nozzle row units that are arranged close to said line of action, that is arranged closest to a center point between said pair of points of action as a reference.

4. A liquid ejecting apparatus according to claim 1, wherein:

said medium is intermittently carried in a direction that intersects with a direction of movement of said moving unit; and while said medium is stopped, said controller makes said moving unit move and eject liquid onto said medium.

5. A liquid ejecting apparatus according to claim 1, wherein:

said controller makes each of said nozzle rows eject liquid to form dots onto said medium; and said position is adjusted based on dot rows formed on said medium.

6. A liquid ejecting apparatus according to claim 5, wherein:

a liquid droplet amount per nozzle for forming said dot rows for adjusting said position is less than a maximum liquid droplet amount ejected by said nozzle.

7. A liquid ejecting apparatus according to claim 1, wherein:

each of said nozzle rows is a single row in which a plurality of nozzles have been arranged in a line.

8. A liquid ejecting apparatus according to claim 1, wherein:

each of said nozzle row units is a print head, said print head including at least a nozzle row capable of ejecting black ink, a nozzle row capable of ejecting cyan ink, a nozzle row capable of ejecting magenta ink, and a nozzle row capable of ejecting yellow ink.

9. A liquid ejecting apparatus according to claim 1, wherein:

the adjustment of said position of each of said nozzle row units includes aligning of an orientation of each of said nozzle row units with respect to said nozzle row unit that has been taken as said reference.

10. A liquid ejecting apparatus according to claim 1, wherein:

the adjustment of said position of each of said nozzle row units includes aligning of a relative position, in a direction of movement of said moving unit, of each of said nozzle row units with respect to said nozzle row unit that has been taken as said reference.

11. A liquid ejecting apparatus according to claim 1, wherein:

said medium is intermittently carried in a direction that intersects with a direction of movement of said moving unit; and the adjustment of said position of each of said nozzle row units includes aligning of a relative position, in said direction of the intermittent carrying, of each of said nozzle row units with respect to said nozzle row unit that has been taken as said reference.

12. A liquid ejecting apparatus according to claim 1, wherein:

said liquid is an ink for printing a print image on said medium.

13. A liquid ejecting apparatus according to claim 1, wherein:

a single image is created using at least two of said nozzle row units whose positions are adjustable independent of one another.

* * * * *